US010054011B2

(12) United States Patent
Kalina

(10) Patent No.: US 10,054,011 B2
(45) Date of Patent: Aug. 21, 2018

(54) POWER SYSTEMS AND METHODS CONFIGURING AND USING SAME

(71) Applicant: KALEX, LLC, Belmont, CA (US)

(72) Inventor: Alexander I. Kalina, Hillsborough, CA (US)

( * ) Notice: Subject to any disclaimer, the term of this patent is extended or adjusted under 35 U.S.C. 154(b) by 42 days.

(21) Appl. No.: 14/955,034

(22) Filed: Nov. 30, 2015

(65) Prior Publication Data

US 2017/0152764 A1 Jun. 1, 2017

(51) Int. Cl.

| | |
|---|---|
| ***F01K 17/06*** | (2006.01) |
| ***F01K 11/02*** | (2006.01) |
| ***F01K 21/04*** | (2006.01) |
| ***F01K 25/08*** | (2006.01) |

(52) U.S. Cl.

CPC ..... *F01K 17/06* (2013.01); *F01K 11/02* (2013.01); *F01K 21/04* (2013.01); *F01K 25/08* (2013.01)

(58) Field of Classification Search

CPC ..... F01K 17/06; F01K 11/02; F01K 21/04; F01K 25/08

See application file for complete search history.

(56) References Cited

U.S. PATENT DOCUMENTS

| | | | | |
|---|---|---|---|---|
| 5,649,426 | A * | 7/1997 | Kalina | F01K 25/065 60/649 |
| 5,950,433 | A * | 9/1999 | Kalina | F01K 25/065 60/649 |
| 2004/0182084 | A1* | 9/2004 | Kalina | F01K 25/065 60/698 |
| 2008/0000225 | A1* | 1/2008 | Kalina | F01K 25/065 60/517 |
| 2011/0067400 | A1* | 3/2011 | Kalina | F01K 25/10 60/651 |
| 2011/0185727 | A1* | 8/2011 | Kalina | F01K 3/00 60/641.8 |

* cited by examiner

*Primary Examiner* — Patrick Maines
(74) *Attorney, Agent, or Firm* — Robert W Strozier

(57) ABSTRACT

Systems and methods based on the systems to convert a portion of thermal energy into to mechanical and/or electrical energy including a power generation subsystem (PGSS) comprising a vaporization and power generation subsystem (VPSS) including a heat recovery vapor generator (HRVG) and a turbine T1, a heating and cooling subsystem (HCSS) including three parallel configured heat exchange units HE3, HE4, and HE5, a single heat exchange unit HE2, and a first separator SP1, and a condensing subsystem (CSS) including a final condenser HE1*b* from a heat source subsystem (HSSS) including a heat source producing an initial heat source stream.

19 Claims, 7 Drawing Sheets

POWER SYSTEMS AND METHODS CONFIGURING AND USING SAME

BACKGROUND OF THE INVENTION

1. Field of the Invention

Embodiments of the present invention apply systems and methods to convert a portion of thermal energy into to mechanical and/or electrical energy. The systems and methods are designed for the generation of mechanical/electrical power utilizing any heat source, but with a particular facility for such fuel sources as biomass and municipal waste.

Embodiments of the present invention apply systems and methods to convert a portion of thermal energy into to mechanical and/or electrical energy, where the systems include a heat recovery vapor generator (HRVG) associated with combustor subsystem, which may be a recuperative combustor subsystem (RCSS), a heating/cooling subsystem (H/CSS) and condensing subsystem (CSS).

2. Description of the Related Art

Although many power generation systems and methodologies have been developed for the conversion of a portion of the energy in heat of heat source stream into usable forms of energy, there is still a need in the art for new systems, especially systems that are capable of utilizing at least two separate heat source stream simultaneously.

SUMMARY OF THE INVENTION

The system uses a multi-component, variable composition working fluid; in particular a mix of at least two components with different boiling temperatures. Specifically, water and ammonia are used in the preferred embodiment of the proposed system, though the proposed invention is not limited to these. Hereafter these are designated as the low-boiling (ammonia) and the high-boiling (water) component.

BRIEF DESCRIPTION OF THE DRAWINGS

The invention can be better understood with reference to the following detailed description together with the appended illustrative drawings in which like elements are numbered the same.

DEFINITIONS USED IN THE INVENTION

Figure 1:
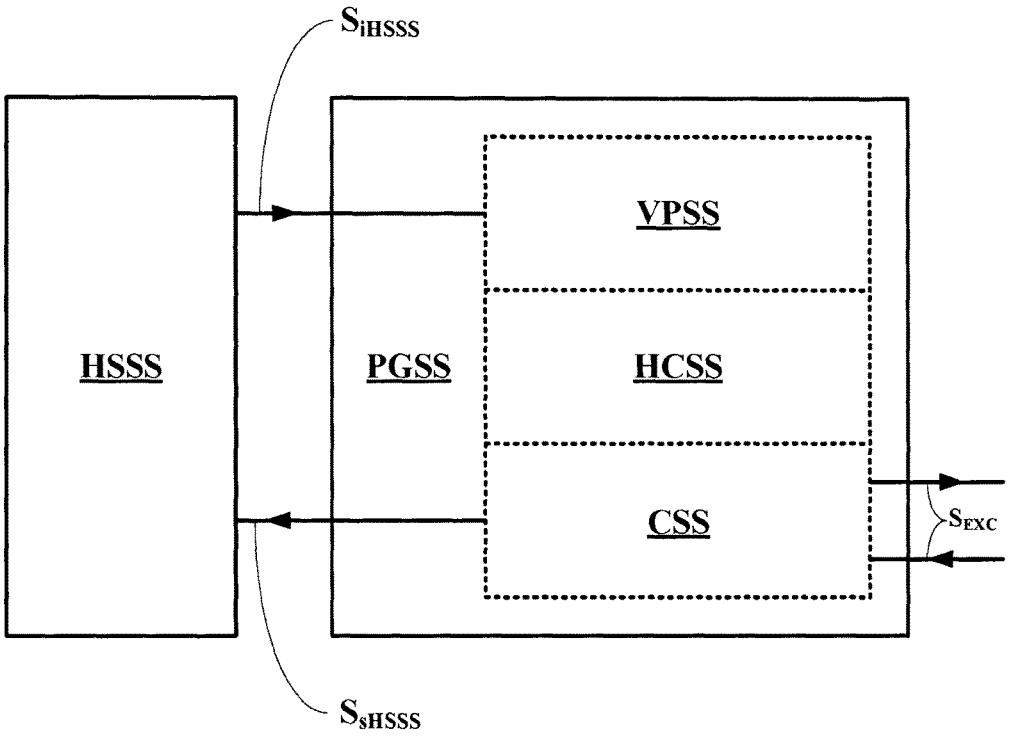
FIG. 1 depicts a system of this invention including an HCSS and a PGSS.

The term "substantially" means that the property is within 95% of its desired value. In other embodiments, "substantially" means that the property is within 97.5% of its desired value. In other embodiments, "substantially" means that the property is within 99% of its desired value. In other embodiments, "substantially" means that the property is within 99.9% of its desired value. For example, the term "substantially complete" as it relates to a coating, means that the coating is at least 95% complete. In other embodiments, the term "substantially complete" as it relates to a coating, means that the coating is at least 97.5% complete. In other embodiments, the term "substantially complete" as it relates to a coating, means that the coating is at least 99% complete. In other embodiments, the term "substantially complete" as it relates to a coating, means that the coating is at least 99.9% complete.

The term "substantially" means that a value is within about ±5% of the indicated value. In certain embodiments, the value is within about ±2.5% of the indicated value. In certain embodiments, the value is within about ±1% of the indicated value. In certain embodiments, the value is within about ±0.5% of the indicated value. In certain embodiments, the value is within about ±0.1% of the indicated value. In certain embodiments, the value is within about ±0.01% of the indicated value.

The term "about" means that the value is within about ±10% of the indicated value. In certain embodiments, the value is within about ±5% of the indicated value. In certain embodiments, the value is within about ±2.5% of the indicated value. In certain embodiments, the value is within about ±1% of the indicated value. In certain embodiments, the value is within about ±0.5% of the indicated value. The term "about" means that the property is within about ±10% of the indicated value. In certain embodiments, the property is within about ±5% of the indicated value. In certain embodiments, the property is within about ±2.5% of the indicated value. In certain embodiments, the property is within about ±1% of the indicated value. In certain embodiments, the property is within about ±0.5% of the indicated value.

The term "mixture" means that two are more components have been mixed together to form a mixture before use.

The term "combination" means that two or more components are used separately and the final composition includes a combination of material made from single components.

DETAILED DESCRIPTION OF THE INVENTION

The inventor has found that systems using multi-component, variable composition working fluids may be constructed the improve efficiency of the systems and methods implementing the systems. In particular, a mix of at least two components with different boiling point temperatures. In certain embodiments, a water and ammonia mixture may be used in the present systems. Hereafter, for a water/ammonia working fluid, ammonia is designated as the low-boiling components and water is designated as the high-boiling (water) component. Rich streams are streams that include a higher concentration of the lower boiling component and lean streams are streams that include a lower concentration of the lower boiling component. Embodiments of this invention relate to processes for generating power from a heat source stream comprising a) providing a heat source stream to a power generation subsystem (PGSS) comprising a vaporization and power generation subsystem (VPSS) including a heat recovery vapor generator (HRVG) and a turbine T1, a heating and cooling subsystem (HCSS) including three parallel configured heat exchange units HE3, HE4, and HE5, a single heat exchange unit HE2, and a first separator SP1, and a condensing subsystem (CSS) including a final condenser HE1*b* from a heat source subsystem (HSSS) including a heat source producing an initial heat source stream, b) vaporizing and superheating a working solution stream in the HRVG using heat from the initial heat source stream to form a vaporized and superheated working solution stream and converting a portion of the heat associated with the vaporized and superheated working solution stream in the turbine T1 into a usable form of energy comprising mechanical and/or electrical energy in the VPSS producing a spent working solution stream, c) heating, cooling, separating, and combining streams derived from the spent working fluid stream to optimize utilization of residual heat in the spent working fluid stream in the heating and cooling subsystem HCSS to produce a condensing stream, and d) condensing the condensing stream in a condensing subsystem CSS using a coolant stream to form a fully condensed basic rich solution stream, which is sent back into the HCSS to be heated with heat from or derived from the spent working fluid stream prior to entering the VPSS.

In certain embodiments, the processes of this invention relate to VPSS further includes a throttle control valve TV1 and the vaporizing and superheating step comprises pressure adjusting the vaporized and superheated working solution stream in the throttle control valve TV1 to form a pressure adjusted, vaporized and superheated working solution stream, and converting a portion of heat in the pressure adjusted, vaporized and superheated working solution stream in the turbine T1 to form the spent working fluid stream.

In other embodiments, the processes of this invention relate to VPSS further includes a second separator SP2 and the vaporizing and superheating step comprises: separating the working solution stream in the a second separator SP2 into a rich vapor stream and a lean liquid stream, vaporizing and superheating the rich vapor stream in the HRVG to form a vaporized and superheated rich stream, vaporizing and superheating the lean liquid stream in the HRVG to form a vaporized and superheated lean stream, combining the vaporized and superheated rich stream and the vaporized and superheated lean stream to the vaporized and superheated working solution stream, and converting a portion of heat in the pressure adjusted, vaporized and superheated working solution stream in the turbine Ti to form the spent working fluid stream.

In certain embodiments, the processes of this invention relate to VPSS further includes a throttle control valve TV1 and a second separator SP2 and the vaporizing and superheating step comprises separating the working solution stream in the a second separator SP2 into a rich vapor stream and a lean liquid stream, vaporizing and superheating the rich vapor stream in the HRVG to form a vaporized and superheated rich stream, vaporizing and superheating the lean liquid stream in the HRVG to form a vaporized and superheated lean stream, combining the vaporized and superheated rich stream and the vaporized and superheated lean stream to the vaporized and superheated working solution stream, pressure adjusting the vaporized and superheated working solution stream in in the throttle control valve TV1 to form a pressure adjusted, vaporized and superheated working solution stream, and converting a portion of heat in the pressure adjusted, vaporized and superheated working solution stream in the turbine Ti to form the spent working fluid stream.

In certain embodiments, the processes of this invention relate to the vaporizing and superheating step comprises combining the initial heat source stream with a higher pressure, cooled heat source substream to form a mixed heat source stream, using the mixed heat source stream as the heat source for the heat recovery vapor generator HRVG to produce a cooled heat source stream, dividing the cooled heat source stream into a first cooled heat source substream and a second cooled heat source substream, pressurizing the second cooled heat source substream in a fan to from the higher pressure, cooled heat source substream, and sending the first cooled heat source substream out of the system.

In certain embodiments, the processes of this invention relate to the vaporizing and superheating step comprises sending the mixed heat source stream into a cyclone separator C to remove any particulate material in the mixed heat source stream to form a substantially particulate free or particulate free heat source stream, and using the substantially particulate free or particulate free heat source stream as the heat source stream for the heat recovery vapor generator HRVG.

In certain embodiments, the processes of this invention relate to feeding a fuel stream and a mixed air flue gas stream into a combustor to form a hot flue gas stream, combining the hot flue gas stream with a first higher pressure, cooled flue gas substream to form a reduced temperature flue gas steam, transferring heat from the reduced temperature flue gas steam to the spent heat source stream from the HRVG to produce the initial heat source stream and a cooled flue gas stream, dividing the cooled flue gas stream into a first cooled flue gas substream and a second cooled flue gas substream, pressurizing the second cooled flue gas substream in a fan to produce a higher pressure, cooled flue gas stream, dividing higher pressure, cooled flue gas stream into a first higher pressure, cooled flue gas substream and a second higher pressure, cooled flue gas sub stream, and combining the second higher pressure, cooled flue gas sub stream with an air stream to from the mixed air flue gas stream.

In certain embodiments, the processes of this invention relate to the HCSS further includes a second pump P2 and a fifth pump P5, the CSS further includes a precondenser HE1*a*, a first pump P1, a third pump P3, and a third separator SP3, the heating, cooling, separating, and combining step comprises: combining the spent working solution stream with a first higher pressure, heated first separator lean substream to form a condensing working fluid stream, dividing the condensing working fluid stream into a first condensing working fluid substream, a second condensing working fluid substream, and a third condensing working fluid substream, simultaneously transferring: a) heat from the first condensing working fluid substream to a preheated, higher pressure, basic rich solution stream in one of the three parallel configured heat exchange units HE3 to form a vaporized or partially vaporized, higher pressure, basic rich solution stream and a cooled first condensing working fluid substream, b) heat from the second condensing working fluid substream to a higher pressure, basic lean solution stream in a second of the three parallel configured heat exchange units HE4 to form a partially vaporized, higher pressure basic lean solution stream and a cooled second condensing working fluid substream, and c) heat from the third condensing working fluid substream to a first higher pressure, first separator lean substream in a third of the three parallel configured heat exchange units HE7 to form the first higher pressure, heated first separator lean substream and a cooled third condensing working fluid substream, combining the cooled first condensing working fluid substream, the cooled second condensing working fluid substream and the cooled third condensing working fluid substream to form a combined working fluid stream, separating the combined working fluid stream in the first separator SP1 to form a vapor first separator rich stream and a liquid first separator lean stream, dividing the liquid first separator lean stream into the first liquid first separator lean substream and a second liquid first separator lean substream, pressurizing the first liquid first separator lean substream in the fifth pump P5 to form the higher pressure, first liquid first separator lean substream, transferring heat form the vapor first separator rich stream to a higher pressure, basic rich solution stream in the single heat exchange unit HE2 to form the preheated, higher pressure, basic rich solution stream and a cooled first separator rich stream, pressurizing the second liquid first separator lean substream in the second pump P2 to form a higher pressure, second liquid first separator lean substream, combining the higher pressure, second liquid first separator lean substream with a second higher pressure, liquid third separator lean stream to form the higher pressure, basic lean solution stream, and combining the vaporized, higher pressure, basic rich solution stream and the partially vaporized, higher pressure, basic lean solution stream to form the working solution stream; and the condensing step comprises: partially condensing the cooled first separator rich stream with a cooled external coolant stream in the precondenser HE1*a* to from a spent external coolant stream and a partially condensed first separator rich stream, separating the partially condensed first separator rich stream in a third separator SP3 to form a vapor third separator rich stream and a liquid third separator lean stream, dividing the liquid third separator lean stream into a first liquid third separator lean substream and a second liquid third separator lean substream, pressurizing the second liquid third separator lean substream in the third pump P3 to form the second higher pressure, liquid third separator lean substream, combining the vapor third separator rich stream with the first liquid third separator lean substream to form a basic rich solution stream, condensing the basic rich solution stream in the final condenser HE1*b* with a coolant stream to form a fully condensed, basic rich solution stream and the cooled coolant stream, and pressurizing the fully condensed, basic rich solution stream in the first pump P1 to form the higher pressure, fully condensed, basic rich solution stream.

In certain embodiments, the processes of this invention relate to feeding a fuel stream and a mixed air flue gas stream into a combustor to form a hot flue gas stream, combining the hot flue gas stream with a first higher pressure, cooled flue gas substream to form a reduced temperature flue gas steam, transferring heat from the reduced temperature flue gas steam to the spent heat source stream from the HRVG to produce the initial heat source stream and a cooled flue gas stream, dividing the cooled flue gas stream into a first cooled flue gas substream and a second cooled flue gas substream, pressurizing the second cooled flue gas substream in a fan to produce a higher pressure, cooled flue gas stream, dividing higher pressure, cooled flue gas stream into a first higher pressure, cooled flue gas substream and a second higher pressure, cooled flue gas sub stream, and combining the second higher pressure, cooled flue gas sub stream with an air stream to from the mixed air flue gas stream.

In certain embodiments, the processes of this invention relate to the HCSS further includes two parallel configured heat exchange units HE5 and HE6, a second pump P2, and a fifth pump P5, the CSS further includes a first pump P1, the vaporizing and superheating step comprises: dividing the spent working solution stream into a first spent working solution substream and a spent working solution substream, simultaneously transferring: a) heat from the first spent working solution substream to a heated preheated, higher pressure, basic rich solution stream in one of the two parallel configured heat exchange units HE5 to form a vaporized or superheated, higher pressure, basic rich solution stream and a cooled first spent working solution substream, and b) heat from the second spent working solution substream to a heated, higher pressure, basic lean solution stream in a second of the two parallel configured heat exchange units HE6 to form a partially vaporized, higher pressure, basic lean solution stream and a cooled second spent working solution substream, combining the cooled first spent working solution substream with a cooled second spent working solution substream to form a cooled spent working solution stream, combining the cooled spent working solution stream with a first higher pressure, heated first separator lean substream to form a condensing working fluid stream, simultaneously transferring: a) heat from the first condensing working fluid substream to a preheated, higher pressure, basic rich solution stream in one of the three parallel configured heat exchange units HE3 to form a vaporized or partially vaporized, higher pressure, basic rich solution stream and a cooled first condensing working fluid substream, b) heat from the second condensing working fluid substream to a higher pressure, basic lean solution stream in a second of the three parallel configured heat exchange units HE4 to form a partially vaporized, higher pressure basic lean solution stream and a cooled second condensing working fluid substream, and c) heat from the third condensing working fluid substream to a first higher pressure, first separator lean substream in a third of the three parallel configured heat exchange units HE7 to form the first higher pressure, heated first separator lean substream and a cooled third condensing working fluid substream, combining the cooled first condensing working fluid substream, the cooled second condensing working fluid substream and the cooled third condensing working fluid substream to form a combined working fluid stream, separating the combined working fluid stream in the first separator SP1 to form a vapor first separator rich stream and a liquid first separator lean stream, dividing the liquid first separator lean stream into the first liquid first separator lean substream, a second liquid first separator lean substream and a third liquid first separator lean substream, pressurizing the first liquid first separator lean substream in the fifth pump P5 to form the higher pressure, first liquid first separator lean substream, combining the third liquid first separator lean substream with the vapor first separator rich stream to form a basic rich solution stream, transferring heat form the basic rich solution stream to a higher pressure, fully condensed basic rich solution stream in the single heat exchange unit HE2 to form the preheated, higher pressure, basic rich solution stream and a cooled basic rich solution stream, and pressurizing the second liquid first separator lean substream in the second pump P2 to form a higher pressure, second liquid first separator lean substream, and the condensing step comprises: condensing the cooled basic rich solution stream in the final condenser HE1*b* with a coolant stream to form a fully condensed, basic rich solution stream and a spent coolant stream, and pressurizing the fully condensed, basic rich solution stream in a first pump P1 to form the higher pressure, fully condensed, basic rich solution stream.

In certain embodiments, the processes of this invention relate to feeding a fuel stream and a mixed air flue gas stream into a combustor to form a hot flue gas stream, combining the hot flue gas stream with a first higher pressure, cooled flue gas substream to form a reduced temperature flue gas steam, transferring heat from the reduced temperature flue gas steam to the spent heat source stream from the HRVG to produce the initial heat source stream and a cooled flue gas stream, dividing the cooled flue gas stream into a first cooled flue gas substream and a second cooled flue gas substream, pressurizing the second cooled flue gas substream in a fan to produce a higher pressure, cooled flue gas stream, dividing higher pressure, cooled flue gas stream into a first higher pressure, cooled flue gas substream and a second higher pressure, cooled flue gas sub stream, and combining the second higher pressure, cooled flue gas sub stream with an air stream to from the mixed air flue gas stream.

In certain embodiments, the processes of this invention relate to the HCSS further includes two parallel configured heat exchange units HE5 and HE6, a second pump P2, and a fifth pump P5, the CSS further includes a third separator SP3, a first pump P1, and a third pump P3, the vaporizing and superheating step comprises: dividing the spent working solution stream into a first spent working solution substream and a spent working solution substream, simultaneously transferring: a) heat from the first spent working solution substream to a heated preheated, higher pressure, basic rich solution stream in one of the two parallel configured heat exchange units HE5 to form a vaporized or superheated, higher pressure, basic rich solution stream and a cooled first spent working solution substream, and b) heat from the second spent working solution substream to a heated, higher pressure, basic lean solution stream in the second of the two parallel configured heat exchange units HE6 to form a partially vaporized, higher pressure, basic lean solution stream and a cooled second spent working solution substream, combining the cooled first spent working solution substream with a cooled second spent working solution substream to form a cooled spent working solution stream, combining the cooled spent working solution stream with a first higher pressure, heated first separator lean substream to form a condensing working fluid stream, simultaneously transferring: a) heat from the first condensing working fluid substream to a preheated, higher pressure, basic rich solution stream in one of the three parallel configured heat exchange units HE3 to form a vaporized or partially vaporized, higher pressure, basic rich solution stream and a cooled first condensing working fluid substream, b) heat from the second condensing working fluid substream to a higher pressure, basic lean solution stream in the second of the three parallel configured heat exchange units HE4 to form a partially vaporized, higher pressure basic lean solution stream and a cooled second condensing working fluid substream, and c) heat from the third condensing working fluid substream to a first higher pressure, first separator lean substream in the third of the three parallel configured heat exchange units HE7 to form the first higher pressure, heated first separator lean substream and a cooled third condensing working fluid substream, combining the cooled first condensing working fluid substream, the cooled second condensing working fluid substream and the cooled third condensing working fluid substream to form a combined working fluid stream, separating the combined working fluid stream in the first separator SP1 to form a vapor first separator rich stream and a liquid first separator lean stream, dividing the liquid first separator lean stream into the first liquid first separator lean substream, a second liquid first separator lean substream and a third liquid first separator lean substream, pressurizing the first liquid first separator lean substream in the fifth pump P5 to form the higher pressure, first liquid first separator lean substream, combining the third liquid first separator lean substream with the vapor first separator rich stream to form a basic rich solution stream, transferring heat form the vapor first separator rich stream to a higher pressure, fully condensed basic rich solution stream in the single heat exchange unit HE2 to form the preheated, higher pressure, basic rich solution stream and a mixed first separator rich stream, and pressurizing the second liquid first separator lean substream in a second pump P2 to form a higher pressure, second liquid first separator lean substream, and the condensing step comprises: separating the mixed first separator rich stream in a third separator SP3 to form a vapor third separator rich stream and a liquid third separator lean stream, dividing the liquid third separator lean stream into a first liquid third separator lean substream and a second liquid third separator lean substream, pressurizing the second liquid third separator lean substream in a third pump P3 to form the second higher pressure, liquid third separator lean substream, combining the vapor third separator rich stream with the first liquid third separator lean substream to form a basic rich solution stream, condensing the basic rich solution stream in a final condenser HE1*b* with a coolant stream to form a fully condensed, basic rich solution stream and the cooled coolant stream, and pressurizing the fully condensed, basic rich solution stream in a first pump P1 to form the higher pressure, fully condensed, basic rich solution stream.

In certain embodiments, the processes of this invention relate to feeding a fuel stream and a mixed air flue gas stream into a combustor to form a hot flue gas stream, combining the hot flue gas stream with a first higher pressure, cooled flue gas substream to form a reduced temperature flue gas steam, transferring heat from the reduced temperature flue gas steam to the spent heat source stream from the HRVG to produce the initial heat source stream and a cooled flue gas stream, dividing the cooled flue gas stream into a first cooled flue gas substream and a second cooled flue gas substream, pressurizing the second cooled flue gas substream in a fan to produce a higher pressure, cooled flue gas stream, dividing higher pressure, cooled flue gas stream into a first higher pressure, cooled flue gas substream and a second higher pressure, cooled flue gas sub stream, and combining the second higher pressure, cooled flue gas sub stream with an air stream to from the mixed air flue gas stream.

In certain embodiments, the processes of this invention relate to the HCSS further includes two parallel configured heat exchange units HE5 and HE6, a second pump P2, and a fifth pump P5, the CSS further includes a precondenser HE1*a*, a first pump P1, and a third separator SP3, the vaporizing and superheating step comprises: dividing the spent working solution stream into a first spent working solution substream and a spent working solution substream, simultaneously transferring: a) heat from the first spent working solution substream to a heated preheated, higher pressure, basic rich solution stream in one of the two parallel configured heat exchange units HE5 to form a vaporized or superheated, higher pressure, basic rich solution stream and a cooled first spent working solution substream, and b) heat from the second spent working solution substream to a heated, higher pressure, basic lean solution stream in a second of the two parallel configured heat exchange units HE6 to form a partially vaporized, higher pressure, basic lean solution stream and a cooled second spent working solution substream, combining the cooled first spent working solution substream with a cooled second spent working solution substream to form a cooled spent working solution stream, combining the cooled spent working solution stream with a first higher pressure, heated first separator lean substream to form a condensing working fluid stream, simultaneously transferring: a) heat from the first condensing working fluid substream to a preheated, higher pressure, basic rich solution stream in one of the three parallel configured heat exchange units HE3 to form a vaporized or partially vaporized, higher pressure, basic rich solution stream and a cooled first condensing working fluid substream, b) heat from the second condensing working fluid substream to a higher pressure, basic lean solution stream in a second of the three parallel configured heat exchange units HE4 to form a partially vaporized, higher pressure basic lean solution stream and a cooled second condensing working fluid substream, and c) heat from the third condensing working fluid substream to a first higher pressure, first separator lean substream in a third of the three parallel configured heat exchange units HE7 to form the first higher pressure, heated first separator lean substream and a cooled third condensing working fluid substream, combining the cooled first condensing working fluid substream, the cooled second condensing working fluid substream and the cooled third condensing working fluid substream to form a combined working fluid stream, separating the combined working fluid stream in the first separator SP1 to form a vapor first separator rich stream and a liquid first separator lean stream, dividing the liquid first separator lean stream into the first liquid first separator lean substream and a second liquid first separator lean substream, pressurizing the first liquid first separator lean substream in the fifth pump P5 to form the higher pressure, first liquid first separator lean substream, transferring heat form the vapor first separator rich stream to a higher pressure, fully condensed basic rich solution stream in the single heat exchange unit HE2 to form the preheated, higher pressure, basic rich solution stream and a cooled first separator rich stream, and pressurizing the second liquid first separator lean substream in a second pump P2 to form a higher pressure, second liquid first separator lean substream, and the condensing step comprises: partially condensing the cooled first separator rich stream with a cooled external coolant stream in the precondenser HE1*a* to from a spent external coolant stream and a partially condensed first separator rich stream, separating the partially condensed first separator rich stream in a third separator SP3 to form a vapor third separator rich stream and a liquid third separator lean stream, dividing the liquid third separator lean stream into a first liquid third separator lean substream and a second liquid third separator lean substream, pressurizing the second liquid third separator lean substream in the third pump P3 to form the second higher pressure, liquid third separator lean substream, combining the vapor third separator rich stream with the first liquid third separator lean substream to form a basic rich solution stream, condensing the basic rich solution stream in the final condenser HE1*b* with a coolant stream to form a fully condensed, basic rich solution stream and the cooled coolant stream, and pressurizing the fully condensed, basic rich solution stream in the first pump P1 to form the higher pressure, fully condensed, basic rich solution stream.

In certain embodiments, the processes of this invention relate to feeding a fuel stream and a mixed air flue gas stream into a combustor to form a hot flue gas stream, combining the hot flue gas stream with a first higher pressure, cooled flue gas substream to form a reduced temperature flue gas steam, transferring heat from the reduced temperature flue gas steam to the spent heat source stream from the HRVG to produce the initial heat source stream and a cooled flue gas stream, dividing the cooled flue gas stream into a first cooled flue gas substream and a second cooled flue gas substream, pressurizing the second cooled flue gas substream in a fan to produce a higher pressure, cooled flue gas stream, dividing higher pressure, cooled flue gas stream into a first higher pressure, cooled flue gas substream and a second higher pressure, cooled flue gas sub stream, and combining the second higher pressure, cooled flue gas sub stream with an air stream to from the mixed air flue gas stream.

In certain embodiments, the processes of this invention for generating power from a heat source stream comprising: providing a power system comprising: a power generation subsystem (PGSS) including: a vaporization and power generation subsystem (VPSS) comprising: a heat recovery vapor generator HRVG, a throttle control valve TV1, a second separator SP2, a cyclone separator C, and a fan F4, a heating and cooling subsystem (HCSS) comprising: two parallel configured heat exchange units HE5 and HE6, three parallel configured heat exchange units HE3, HE4, and HE7, a single heat exchange unit HE2, a first separator SP1, a second pump P2 and, a fifth pump P5, a condensing subsystem (CSS) comprising: a precondenser HE1*a*, a final condenser HE1*b*, a third separator SP3, a first pump P1, and a third pump P3, and a heat source subsystem (HSSS) including: a first RCSS heat exchange unit RCSSHE1, a fan F, a combustor or combustion chamber CC, an air source AS, a fuel source FS, feeding a fuel stream and a mixed air flue gas stream into a combustor to form a hot flue gas stream, combining the hot flue gas stream with a first higher pressure, cooled flue gas substream to form a reduced temperature flue gas steam, transferring heat from the reduced temperature flue gas steam to the spent heat source stream from the HRVG in the first RCSS heat exchange unit RCSSHE1 to produce the initial heat source stream and a cooled flue gas stream, dividing the cooled flue gas stream into a first cooled flue gas substream and a second cooled flue gas substream, pressurizing the second cooled flue gas substream in a fan to produce a higher pressure, cooled flue gas stream, dividing higher pressure, cooled flue gas stream into a first higher pressure, cooled flue gas substream and a second higher pressure, cooled flue gas sub stream, combining the second higher pressure, cooled flue gas sub stream with an air stream from the air source AS to from the mixed air flue gas stream, separating the working solution stream in the a second separator SP2 into a rich vapor stream and a lean liquid stream, vaporizing and superheating the rich vapor stream in the HRVG to form a vaporized and superheated rich stream, vaporizing and superheating the lean liquid stream in the HRVG to form a vaporized and superheated lean stream, combining the vaporized and superheated rich stream and the vaporized and superheated lean stream to the vaporized and superheated working solution stream, and converting a portion of heat in the pressure adjusted, vaporized and superheated working solution stream in the turbine T1 to form the spent working fluid stream, pressure adjusting the vaporized and superheated working solution stream in in the throttle control valve TV1 to form a pressure adjusted, vaporized and superheated working solution stream and converting a portion of heat in the pressure adjusted, vaporized and superheated working solution stream in the turbine T1 to form the spent working fluid stream, combining the initial heat source stream with a higher pressure, cooled heat source substream to form a mixed heat source stream, dividing the cooled heat source stream into a first cooled heat source substream and a second cooled heat source substream, pressurizing the second cooled heat source substream in a fan F4 to from the higher pressure, cooled heat source substream, sending the mixed heat source stream into a cyclone separator C to remove any particulate material in the mixed heat source stream to form a substantially particulate free or particulate free heat source stream, using the substantially particulate free or particulate free heat source stream as the heat source stream for the heat recovery vapor generator HRVG, combining the spent working solution stream with a first higher pressure, heated first separator lean substream to form a condensing working fluid stream, dividing the condensing working fluid stream into a first condensing working fluid substream, a second condensing working fluid substream, and a third condensing working fluid substream, simultaneously transferring: a) heat from the first condensing working fluid substream to a preheated, higher pressure, basic rich solution stream in one of the three parallel configured heat exchange units HE3 to form a vaporized or partially vaporized, higher pressure, basic rich solution stream and a cooled first condensing working fluid substream, b) heat from the second condensing working fluid substream to a higher pressure, basic lean solution stream in a second of the three parallel configured heat exchange units HE4 to form a partially vaporized, higher pressure basic lean solution stream and a cooled second condensing working fluid substream, and c) heat from the third condensing working fluid substream to a first higher pressure, first separator lean substream in a third of the three parallel configured heat exchange units HE7 to form the first higher pressure, heated first separator lean substream and a cooled third condensing working fluid substream, combining the cooled first condensing working fluid substream, the cooled second condensing working fluid substream and the cooled third condensing working fluid substream to form a combined working fluid stream, separating the combined working fluid stream in the first separator SP1 to form a vapor first separator rich stream and a liquid first separator lean stream, dividing the liquid first separator lean stream into the first liquid first separator lean substream and a second liquid first separator lean substream, pressurizing the first liquid first separator lean substream in the fifth pump P5 to form the higher pressure, first liquid first separator lean substream, transferring heat form the vapor first separator rich stream to a higher pressure, basic rich solution stream in the single heat exchange unit HE2 to form the preheated, higher pressure, basic rich solution stream and a cooled first separator rich stream, pressurizing the second liquid first separator lean substream in the second pump P2 to form a higher pressure, second liquid first separator lean substream, combining the higher pressure, second liquid first separator lean substream with a second higher pressure, liquid third separator lean stream to form the higher pressure, basic lean solution stream, and combining the vaporized, higher pressure, basic rich solution stream and the partially vaporized, higher pressure, basic lean solution stream to form the working solution stream; partially condensing the cooled first separator rich stream with a cooled external coolant stream in the precondenser HE1*a* to from a spent external coolant stream and a partially condensed first separator rich stream, separating the partially condensed first separator rich stream in a third separator SP3 to form a vapor third separator rich stream and a liquid third separator lean stream, dividing the liquid third separator lean stream into a first liquid third separator lean substream and a second liquid third separator lean substream, pressurizing the second liquid third separator lean substream in the third pump P3 to form the second higher pressure, liquid third separator lean substream, combining the vapor third separator rich stream with the first liquid third separator lean substream to form a basic rich solution stream, condensing the basic rich solution stream in the final condenser HE1*b* with a coolant stream to form a fully condensed, basic rich solution stream and the cooled coolant stream, and pressurizing the fully condensed, basic rich solution stream in the first pump P1 to form the higher pressure, fully condensed, basic rich solution stream.

In certain embodiments, the processes of this invention for generating power from a heat source stream comprising: providing a power system comprising: a power generation subsystem (PGSS) including: a vaporization and power generation subsystem (VPSS) comprising: a heat recovery vapor generator HRVG, a throttle control valve TV1, a second separator SP2, a cyclone separator C, and a fan F4, a heating and cooling subsystem (HCSS) comprising: two parallel configured heat exchange units HE5 and HE6, three parallel configured heat exchange units HE3, HE4, and HE7, a single heat exchange unit HE2, a first separator SP1, a second pump P2 and, a fifth pump P5, a condensing subsystem (CSS) comprising: a precondenser HEla, a final condenser HElb, a third separator SP3, a first pump P1, and a third pump P3, and a heat source subsystem (HSSS) including: a first RCSS heat exchange unit RCSSHE1, a fan F, a combustor or combustion chamber CC, an air source AS, a fuel source FS, feeding a fuel stream and a mixed air flue gas stream into a combustor to form a hot flue gas stream, combining the hot flue gas stream with a first higher pressure, cooled flue gas substream to form a reduced temperature flue gas steam, transferring heat from the reduced temperature flue gas steam to the spent heat source stream from the HRVG in the first RCSS heat exchange unit RCSSHE1 to produce the initial heat source stream and a cooled flue gas stream, dividing the cooled flue gas stream into a first cooled flue gas substream and a second cooled flue gas substream, pressurizing the second cooled flue gas substream in a fan to produce a higher pressure, cooled flue gas stream, dividing higher pressure, cooled flue gas stream into a first higher pressure, cooled flue gas substream and a second higher pressure, cooled flue gas sub stream, combining the second higher pressure, cooled flue gas sub stream with an air stream from the air source AS to from the mixed air flue gas stream, separating the working solution stream in the a second separator SP2 into a rich vapor stream and a lean liquid stream, vaporizing and superheating the rich vapor stream in the HRVG to form a vaporized and superheated rich stream, vaporizing and superheating the lean liquid stream in the HRVG to form a vaporized and superheated lean stream, combining the vaporized and superheated rich stream and the vaporized and superheated lean stream to the vaporized and superheated working solution stream, and converting a portion of heat in the pressure adjusted, vaporized and superheated working solution stream in the turbine T1 to form the spent working fluid stream, pressure adjusting the vaporized and superheated working solution stream in in the throttle control valve TV1 to form a pressure adjusted, vaporized and superheated working solution stream and converting a portion of heat in the pressure adjusted, vaporized and superheated working solution stream in the turbine T1 to form the spent working fluid stream, combining the initial heat source stream with a higher pressure, cooled heat source substream to form a mixed heat source stream, dividing the cooled heat source stream into a first cooled heat source substream and a second cooled heat source substream, pressurizing the second cooled heat source substream in a fan F4 to from the higher pressure, cooled heat source substream, sending the mixed heat source stream into a cyclone separator C to remove any particulate material in the mixed heat source stream to form a substantially particulate free or particulate free heat source stream, using the substantially particulate free or particulate free heat source stream as the heat source stream for the heat recovery vapor generator HRVG, dividing the spent working solution stream into a first spent working solution substream and a spent working solution substream, simultaneously transferring: a) heat from the first spent working solution substream to a heated preheated, higher pressure, basic rich solution stream in one of the two parallel configured heat exchange units HE5 to form a vaporized or superheated, higher pressure, basic rich solution stream and a cooled first spent working solution substream, and b) heat from the second spent working solution substream to a heated, higher pressure, basic lean solution stream in a second of the two parallel configured heat exchange units HE6 to form a partially vaporized, higher pressure, basic lean solution stream and a cooled second spent working solution substream, combining the cooled first spent working solution substream with a cooled second spent working solution substream to form a cooled spent working solution stream, combining the cooled spent working solution stream with a first higher pressure, heated first separator lean substream to form a condensing working fluid stream, simultaneously transferring: a) heat from the first condensing working fluid substream to a preheated, higher pressure, basic rich solution stream in one of the three parallel configured heat exchange units HE3 to form a vaporized or partially vaporized, higher pressure, basic rich solution stream and a cooled first condensing working fluid substream, b) heat from the second condensing working fluid substream to a higher pressure, basic lean solution stream in a second of the three parallel configured heat exchange units HE4 to form a partially vaporized, higher pressure basic lean solution stream and a cooled second condensing working fluid substream, and c) heat from the third condensing working fluid substream to a first higher pressure, first separator lean substream in a third of the three parallel configured heat exchange units HE7 to form the first higher pressure, heated first separator lean substream and a cooled third condensing working fluid substream, combining the cooled first condensing working fluid substream, the cooled second condensing working fluid substream and the cooled third condensing working fluid substream to form a combined working fluid stream, separating the combined working fluid stream in the first separator SP1 to form a vapor first separator rich stream and a liquid first separator lean stream, dividing the liquid first separator lean stream into the first liquid first separator lean substream, a second liquid first separator lean substream and a third liquid first separator lean substream, pressurizing the first liquid first separator lean substream in the fifth pump P5 to form the higher pressure, first liquid first separator lean substream, combining the third liquid first separator lean substream with the vapor first separator rich stream to form a basic rich solution stream, transferring heat form the basic rich solution stream to a higher pressure, fully condensed basic rich solution stream in the single heat exchange unit HE2 to form the preheated, higher pressure, basic rich solution stream and a cooled basic rich solution stream, and pressurizing the second liquid first separator lean substream in the second pump P2 to form a higher pressure, second liquid first separator lean substream, condensing the cooled basic rich solution stream in the final condenser HE1*b* with a coolant stream to form a fully condensed, basic rich solution stream and a spent coolant stream, and pressurizing the fully condensed, basic rich solution stream in a first pump P1 to form the higher pressure, fully condensed, basic rich solution stream.

In certain embodiments, the processes of this invention for generating power from a heat source stream comprising: providing a power system comprising: a power generation subsystem (PGSS) including: a vaporization and power generation subsystem (VPSS) comprising: a heat recovery vapor generator HRVG, a throttle control valve TV1, a second separator SP2, a cyclone separator C, and a fan F4, a heating and cooling subsystem (HCSS) comprising: two parallel configured heat exchange units HE5 and HE6, three parallel configured heat exchange units HE3, HE4, and HE7, a single heat exchange unit HE2, a first separator SP1, a second pump P2 and, a fifth pump P5, a condensing subsystem (CSS) comprising: a precondenser HE1*a*, a final condenser HE1*b*, a third separator SP3, a first pump P1, and a third pump P3, and a heat source subsystem (HSSS) including: a first RCSS heat exchange unit RCSSHE1, a fan F, a combustor or combustion chamber CC, an air source AS, a fuel source FS, feeding a fuel stream and a mixed air flue gas stream into a combustor to form a hot flue gas stream, combining the hot flue gas stream with a first higher pressure, cooled flue gas substream to form a reduced temperature flue gas steam, transferring heat from the reduced temperature flue gas steam to the spent heat source stream from the HRVG in the first RCSS heat exchange unit RCSSHE1 to produce the initial heat source stream and a cooled flue gas stream, dividing the cooled flue gas stream into a first cooled flue gas substream and a second cooled flue gas substream, pressurizing the second cooled flue gas substream in a fan to produce a higher pressure, cooled flue gas stream, dividing higher pressure, cooled flue gas stream into a first higher pressure, cooled flue gas substream and a second higher pressure, cooled flue gas sub stream, combining the second higher pressure, cooled flue gas sub stream with an air stream from the air source AS to from the mixed air flue gas stream, separating the working solution stream in the a second separator SP2 into a rich vapor stream and a lean liquid stream, vaporizing and superheating the rich vapor stream in the HRVG to form a vaporized and superheated rich stream, vaporizing and superheating the lean liquid stream in the HRVG to form a vaporized and superheated lean stream, combining the vaporized and superheated rich stream and the vaporized and superheated lean stream to the vaporized and superheated working solution stream, and converting a portion of heat in the pressure adjusted, vaporized and superheated working solution stream in the turbine T1 to form the spent working fluid stream, pressure adjusting the vaporized and superheated working solution stream in in the throttle control valve TV1 to form a pressure adjusted, vaporized and superheated working solution stream and converting a portion of heat in the pressure adjusted, vaporized and superheated working solution stream in the turbine T1 to form the spent working fluid stream, combining the initial heat source stream with a higher pressure, cooled heat source substream to form a mixed heat source stream, dividing the cooled heat source stream into a first cooled heat source substream and a second cooled heat source substream, pressurizing the second cooled heat source substream in a fan F4 to from the higher pressure, cooled heat source substream, sending the mixed heat source stream into a cyclone separator C to remove any particulate material in the mixed heat source stream to form a substantially particulate free or particulate free heat source stream, using the substantially particulate free or particulate free heat source stream as the heat source stream for the heat recovery vapor generator HRVG, dividing the spent working solution stream into a first spent working solution substream and a spent working solution substream, simultaneously transferring: a) heat from the first spent working solution substream to a heated preheated, higher pressure, basic rich solution stream in one of the two parallel configured heat exchange units HE5 to form a vaporized or superheated, higher pressure, basic rich solution stream and a cooled first spent working solution substream, and b) heat from the second spent working solution substream to a heated, higher pressure, basic lean solution stream in the second of the two parallel configured heat exchange units HE6 to form a partially vaporized, higher pressure, basic lean solution stream and a cooled second spent working solution substream, combining the cooled first spent working solution substream with a cooled second spent working solution substream to form a cooled spent working solution stream, combining the cooled spent working solution stream with a first higher pressure, heated first separator lean substream to form a condensing working fluid stream, simultaneously transferring: a) heat from the first condensing working fluid substream to a preheated, higher pressure, basic rich solution stream in one of the three parallel configured heat exchange units HE3 to form a vaporized or partially vaporized, higher pressure, basic rich solution stream and a cooled first condensing working fluid substream, b) heat from the second condensing working fluid substream to a higher pressure, basic lean solution stream in the second of the three parallel configured heat exchange units HE4 to form a partially vaporized, higher pressure basic lean solution stream and a cooled second condensing working fluid substream, and c) heat from the third condensing working fluid substream to a first higher pressure, first separator lean substream in the third of the three parallel configured heat exchange units HE7 to form the first higher pressure, heated first separator lean substream and a cooled third condensing working fluid substream, combining the cooled first condensing working fluid substream, the cooled second condensing working fluid substream and the cooled third condensing working fluid substream to form a combined working fluid stream, separating the combined working fluid stream in the first separator SP1 to form a vapor first separator rich stream and a liquid first separator lean stream, dividing the liquid first separator lean stream into the first liquid first separator lean substream, a second liquid first separator lean substream and a third liquid first separator lean substream, pressurizing the first liquid first separator lean substream in the fifth pump P5 to form the higher pressure, first liquid first separator lean substream, combining the third liquid first separator lean substream with the vapor first separator rich stream to form a basic rich solution stream, transferring heat form the vapor first separator rich stream to a higher pressure, fully condensed basic rich solution stream in the single heat exchange unit HE2 to form the preheated, higher pressure, basic rich solution stream and a mixed first separator rich stream, and pressurizing the second liquid first separator lean substream in a second pump P2 to form a higher pressure, second liquid first separator lean substream, separating the mixed first separator rich stream in a third separator SP3 to form a vapor third separator rich stream and a liquid third separator lean stream, dividing the liquid third separator lean stream into a first liquid third separator lean substream and a second liquid third separator lean substream, pressurizing the second liquid third separator lean substream in a third pump P3 to form the second higher pressure, liquid third separator lean substream, combining the vapor third separator rich stream with the first liquid third separator lean substream to form a basic rich solution stream, condensing the basic rich solution stream in a final condenser HE1*b* with a coolant stream to form a fully condensed, basic rich solution stream and the cooled coolant stream, and pressurizing the fully condensed, basic rich solution stream in a first pump P1 to form the higher pressure, fully condensed, basic rich solution stream.

In certain embodiments, the processes of this invention for generating power from a heat source stream comprising: providing a power system comprising: a power generation subsystem (PGSS) including: a vaporization and power generation subsystem (VPSS) comprising: a heat recovery vapor generator HRVG, a throttle control valve TV1, a second separator SP2, a cyclone separator C, and a fan F4, a heating and cooling subsystem (HCSS) comprising: two parallel configured heat exchange units HE5 and HE6, three parallel configured heat exchange units HE3, HE4, and HE7, a single heat exchange unit HE2, a first separator SP1, a second pump P2 and, a fifth pump P5, a condensing subsystem (CSS) comprising: a precondenser HE1*a*, a final condenser HE1*b*, a third separator SP3, a first pump P1, and a third pump P3, and a heat source subsystem (HSSS) including: a first RCSS heat exchange unit RCSSHE1, a fan F, a combustor or combustion chamber CC, an air source AS, a fuel source FS, feeding a fuel stream and a mixed air flue gas stream into a combustor to form a hot flue gas stream, combining the hot flue gas stream with a first higher pressure, cooled flue gas substream to form a reduced temperature flue gas steam, transferring heat from the reduced temperature flue gas steam to the spent heat source stream from the HRVG in the first RCSS heat exchange unit RCSSHE1 to produce the initial heat source stream and a cooled flue gas stream, dividing the cooled flue gas stream into a first cooled flue gas substream and a second cooled flue gas substream, pressurizing the second cooled flue gas substream in a fan to produce a higher pressure, cooled flue gas stream, dividing higher pressure, cooled flue gas stream into a first higher pressure, cooled flue gas substream and a second higher pressure, cooled flue gas sub stream, combining the second higher pressure, cooled flue gas sub stream with an air stream from the air source AS to from the mixed air flue gas stream, separating the working solution stream in the a second separator SP2 into a rich vapor stream and a lean liquid stream, vaporizing and superheating the rich vapor stream in the HRVG to form a vaporized and superheated rich stream, vaporizing and superheating the lean liquid stream in the HRVG to form a vaporized and superheated lean stream, combining the vaporized and superheated rich stream and the vaporized and superheated lean stream to the vaporized and superheated working solution stream, and converting a portion of heat in the pressure adjusted, vaporized and superheated working solution stream in the turbine T1 to form the spent working fluid stream, pressure adjusting the vaporized and superheated working solution stream in in the throttle control valve TV1 to form a pressure adjusted, vaporized and superheated working solution stream and converting a portion of heat in the pressure adjusted, vaporized and superheated working solution stream in the turbine T1 to form the spent working fluid stream, combining the initial heat source stream with a higher pressure, cooled heat source substream to form a mixed heat source stream, dividing the cooled heat source stream into a first cooled heat source substream and a second cooled heat source substream, pressurizing the second cooled heat source substream in a fan F4 to from the higher pressure, cooled heat source substream, sending the mixed heat source stream into a cyclone separator C to remove any particulate material in the mixed heat source stream to form a substantially particulate free or particulate free heat source stream, using the substantially particulate free or particulate free heat source stream as the heat source stream for the heat recovery vapor generator HRVG, dividing the spent working solution stream into a first spent working solution substream and a spent working solution substream, simultaneously transferring: a) heat from the first spent working solution substream to a heated preheated, higher pressure, basic rich solution stream in one of the two parallel configured heat exchange units HE5 to form a vaporized or superheated, higher pressure, basic rich solution stream and a cooled first spent working solution substream, and b) heat from the second spent working solution substream to a heated, higher pressure, basic lean solution stream in a second of the two parallel configured heat exchange units HE6 to form a partially vaporized, higher pressure, basic lean solution stream and a cooled second spent working solution substream, combining the cooled first spent working solution substream with a cooled second spent working solution substream to form a cooled spent working solution stream, combining the cooled spent working solution stream with a first higher pressure, heated first separator lean substream to form a condensing working fluid stream, simultaneously transferring: a) heat from the first condensing working fluid substream to a preheated, higher pressure, basic rich solution stream in one of the three parallel configured heat exchange units HE3 to form a vaporized or partially vaporized, higher pressure, basic rich solution stream and a cooled first condensing working fluid substream, b) heat from the second condensing working fluid substream to a higher pressure, basic lean solution stream in a second of the three parallel configured heat exchange units HE4 to form a partially vaporized, higher pressure basic lean solution stream and a cooled second condensing working fluid substream, and c) heat from the third condensing working fluid substream to a first higher pressure, first separator lean substream in a third of the three parallel configured heat exchange units HE7 to form the first higher pressure, heated first separator lean substream and a cooled third condensing working fluid substream, combining the cooled first condensing working fluid substream, the cooled second condensing working fluid substream and the cooled third condensing working fluid substream to form a combined working fluid stream, separating the combined working fluid stream in the first separator SP1 to form a vapor first separator rich stream and a liquid first separator lean stream, dividing the liquid first separator lean stream into the first liquid first separator lean substream and a second liquid first separator lean substream, pressurizing the first liquid first separator lean substream in the fifth pump P5 to form the higher pressure, first liquid first separator lean substream, transferring heat form the vapor first separator rich stream to a higher pressure, fully condensed basic rich solution stream in the single heat exchange unit HE2 to form the preheated, higher pressure, basic rich solution stream and a cooled first separator rich stream, and pressurizing the second liquid first separator lean substream in a second pump P2 to form a higher pressure, second liquid first separator lean substream, partially condensing the cooled first separator rich stream with a cooled external coolant stream in the precondenser HE1*a* to from a spent external coolant stream and a partially condensed first separator rich stream, separating the partially condensed first separator rich stream in a third separator SP3 to form a vapor third separator rich stream and a liquid third separator lean stream, dividing the liquid third separator lean stream into a first liquid third separator lean substream and a second liquid third separator lean substream, pressurizing the second liquid third separator lean substream in the third pump P3 to form the second higher pressure, liquid third separator lean substream, combining the vapor third separator rich stream with the first liquid third separator lean substream to form a basic rich solution stream, condensing the basic rich solution stream in the final condenser HE1*b* with a coolant stream to form a fully condensed, basic rich solution stream and the cooled coolant stream, and pressurizing the fully condensed, basic rich solution stream in the first pump P1 to form the higher pressure, fully condensed, basic rich solution stream.

Suitable Reagents and Equipment

The working fluid used in the systems of this invention are multi-component fluids comprising a lower boiling point component and a higher boiling point component. Suitable multi-components fluids include, without limitation, ammonia-water mixtures, mixtures of two or more hydrocarbons, mixtures of two or more freon, mixtures of hydrocarbons and freons, or mixtures thereof. In general, the fluid may comprise mixtures of any number of compounds with favorable thermodynamic characteristics and solubility. In certain embodiments, the multi-component fluid comprises a mixture of water and ammonia.

It should be recognized by an ordinary artisan that at those points in the systems of this invention were a stream is split into two or more sub-streams, dividing valves that affect such stream splitting are well known in the art and may be manually adjustable or dynamically adjustable so that the splitting achieves the desired stream flow rates and system efficiencies. Similarly, when stream are combined, combining valve that affect combining are also well known in the art and may be manually adjustable or dynamically adjustable so that the splitting achieves the desired stream flow rates and system efficiencies. The combining and dividing value may also include flow controllers and sensors for determining stream parameters including, without limitation, temperature, pressure, composition, boiling point, etc.

DETAILED DESCRIPTION OF THE DRAWINGS OF THE INVENTION

General System

Referring now to FIG. 1, an embodiment of a power system of this invention, generally PS, is shown to include a heat source subsystem HSSS and a power generation subsystem PGSS. The 11555 supplies an initial heat source stream $S_{iHSSS}$ to the PGSS and receives a spent heat source stream $S_{sHSSS}$ stream from the PGSS. The PGSS a) transfers a portion of the heat with the initial heat source stream $S_{iHSSS}$ to vaporize and superheat a multi-component working fluid, b) converts a portion of the heat associated with the vaporized and superheated multi-component working fluid into a usable form of energy, e.g., electrical/mechanical energy, and c) condenses the working fluid stream using an external coolant $S_{EXC}$. The HSSS may be any subsystem capable of supplying a heat source stream suitable for use in the PGSS. Specific HSSSs are shown and described in FIGS. 6A&B and the accompanying text associated therewith. The power generations subsystem PGSS is described below in reference of FIGS. 2-5 and the associated text.

Power System (PS)

Figure 2:
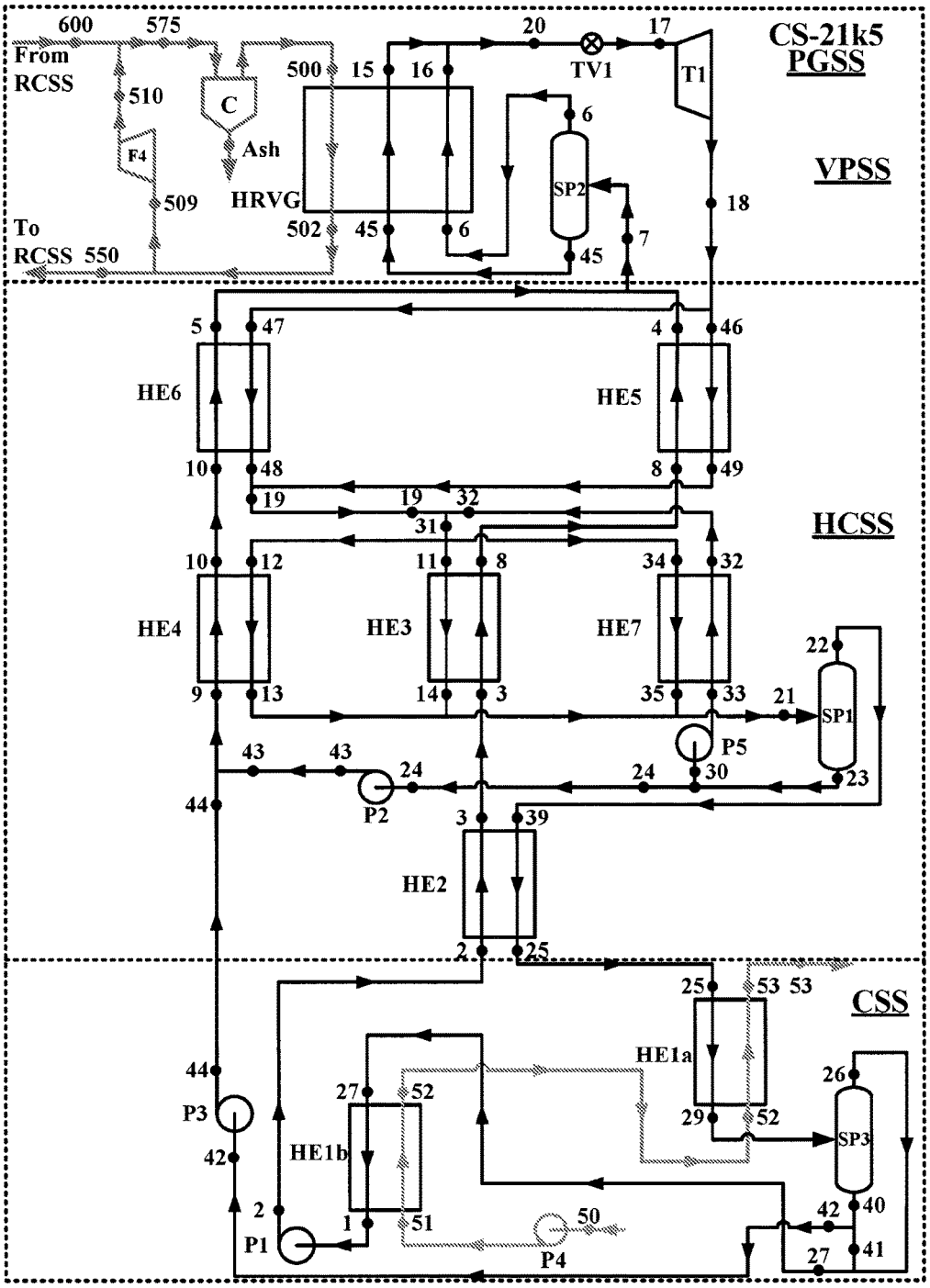
FIG. 2 depicts an embodiment of a power generation system of this invention designated CS-21k5.
Figure 3:
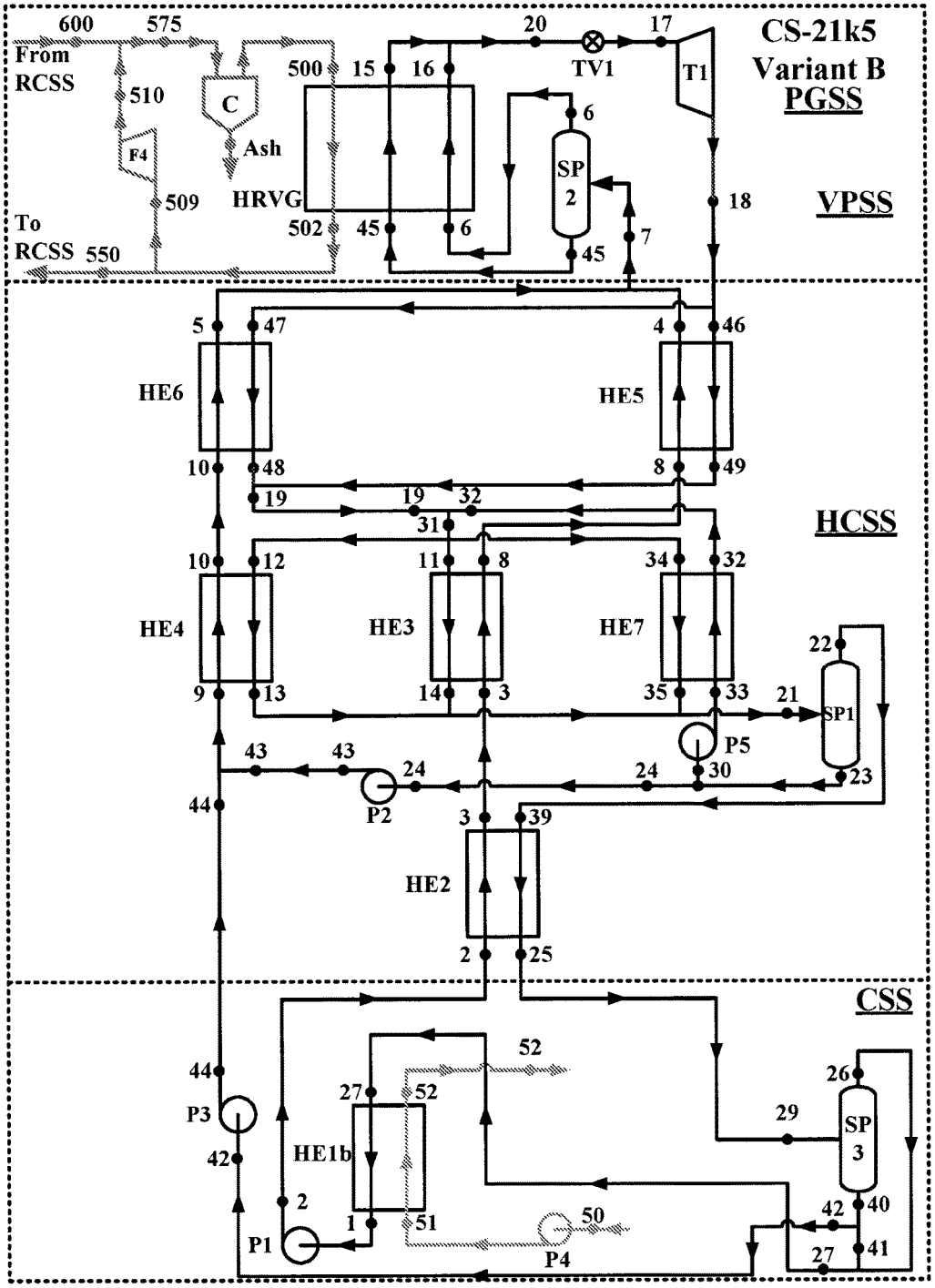
FIG. 3 depicts a first variant of the embodiment of FIG. 1 designated CS-21k5 Variant B.

Referring now to FIG. 2, a fully condensed basic rich solution stream S1 (a solution having a high concentration of the low-boiling component) having parameters as at a point 1, corresponding to a state of saturated liquid, is sent into a feed pump P1, where its pressure is increased to a desired level, producing a higher pressure fully condensed basic rich solution stream S2 having parameters as at a point 2, corresponding to a state of subcooled liquid.

The higher pressure fully condensed basic rich solution stream S2 is then sent into a preheater or second heat exchange unit or exchanger HE2, where it is heated in counterflow by a vapor first separator rich stream S22 or S39 in a heat exchange process 39-25 or 2-3 as described below to produce a preheated higher pressure basic rich solution stream S3 having parameters as at a point 3, corresponding to a state of saturated liquid, and a condensing first separator rich stream S25 having parameters as at a point 25.

The preheated higher pressure basic rich solution stream S3 is then sent into a recuperative boiler-condenser or third heat exchange unit or exchanger HE3, where it is heated in counterflow by a condensing working fluid substream S11 in a heat exchange process 11-14 or 3-8 as described below to produce a heated higher pressure basic rich solution stream S8 having parameters as at a point 8, corresponding either to a state of liquid-vapor mixture or saturated vapor, and a cooled condensing working fluid substream S14 having parameters as at a point 14.

At the same time, a basic lean solution stream S9 (a solution having a lower concentration of the low-boiling component) having parameters as at a point 9, corresponding to a state of subcooled liquid as described below is sent into a fourth heat exchange unit or exchanger HE4, where it is heated in counterflow by a condensing working fluid substream S12 having parameters as a point 12 in a heat exchange process 12-13 or 9-10 as described below to produce a heated basic lean solution stream S10 having parameters as at a point 10, corresponding to state of subcooled liquid, and a cooled condensing working fluid substream S13 having parameters as at a point 13.

Thereafter, the heated higher pressure basic rich solution stream S8 sent into a fifth heat unit or exchanger HES, where it is heated in counterflow by a first spent working solution substream S46 having parameters as a point 46 in a heat exchange process by 46-49 or 8-4 as describe below to produce a superheated higher pressure basic rich solution stream S4 having parameters as at a point 4, corresponding to a state of superheated vapor, and a cooled first spent working solution substream S49 having parameters as at a point 49.

At the same time, the preheated basic lean solution stream S10 is sent through a sixth heat unit or exchanger HE6, where it is heated in counterflow by a second spent working solution substream S47 having parameters as at a point 47 in a heat exchange process 47-48 or 10-5 as described below to produce a heated basic lean solution stream S5 having parameters as at a point 5, corresponding to a state of slightly subcooled liquid, and a cooled second spent working solution substream S48 having parameters as at a point 48.

Thereafter, the superheated basic rich solution stream S4 and the heated basic lean solution stream S5 are combined to produce a working solution stream S7 having parameters as at a point 7, corresponding to a state of liquid-vapor mixture.

The working solution stream S7 is now sent into a second gravity separator or a flash tank SP2, where it is separated into a vapor second separator rich stream S6 having parameters as at a point 6 corresponding to a state of saturated vapor and a liquid second separator lean stream S45 having parameters as at point 45, corresponding to a state of saturated liquid. The temperature and pressure of the saturated vapor vapor second separator rich stream S6 and the saturated liquid liquid second separator lean stream S45 having the parameters as at the points 6 and 45 are the same.

The saturated vapor vapor second separator rich stream S6 and the saturated liquid liquid second separator lean stream S45 are now sent separately into a heat recovery vapor generator HRVG, where they are heated in counterflow by a heat source stream S500 having parameters as at a point 500 in a heat exchange process 500-502 or 45-16 and 6-16 as described see below. Here, the vapor second separator rich stream S6 is further superheated to produce a superheated vapor second separator rich stream S16 having parameters as at a point 16, corresponding to a state of superheated vapor, and likewise, the liquid second separator lean stream S45 is fully vaporized and superheated to produce a superheated vapor second separator lean stream S15 having parameters as at a point 15, corresponding to a state of superheated vapor. The superheated vapor second separator rich stream S16 and the superheated vapor second separator lean stream S15 are then combined to produce a recombined working solution stream S20 having parameters as at a point 20. Note that the composition of the recombined working solution stream S20 is the same as the composition of the working solution stream S7.

The recombined working solution stream S20 is now sent into an admission throttle valve TV1, where its pressure is slightly reduced to produce a pressure adjusted working solution stream S17 having parameters as at a point 17, corresponding to a state of superheated vapor.

Note that it is possible to send the working solution stream S7, without prior separation into the vapor second separator rich stream S6 and the liquid second separator lean stream S45, directly into the HRVG, where it would be heated directly to produce the recombined working solution stream S20 having the parameters as at the point 20. However, in such a case, it will be necessary to have multiple tubes in the HRVG to evenly distribute the vapor and liquid of the working solution stream S7. This may present technical difficulties, which are obviated by the use of the second separator SP2 as described above.

Now, the pressure adjusted working solution stream S17 then passes into and through a turbine T1, where it is expanded to produce power and a spent working solution stream S18 having parameters as at a point 18, corresponding (in most cases) to a state of superheated vapor. Thereafter, the spent working solution stream S18 is divided into a first spent working solution substream S46 having parameters as at a point 46 and a second spent working solution substream S47 having parameters as at a point 47.

Note, the systems of this invention may operate without the use of the admission throttle valve TV1. In such a case, a dedicated control device (of a sort often used with modern turbines) may be used to ensure that the proper flow enters the turbine T1.

The second spent working solution substream S47 now passes into and through the sixth heat exchange unit or exchanger HE6, where it is cooled, providing heat for the heat exchange process 10-5 as described above to produce the cooled second spent working solution substream S48, corresponding to a state of saturated or superheated vapor.

At the same time, the first spent working solution substream S46 passes into and through the fifth heat exchange unit or exchanger HES, where it is cooled, providing heat for the heat exchange process 8-4 described above to produce the cooled first spent working solution substream S49, likewise corresponding to a state of saturated or superheated vapor.

The cooled second spent working solution substream S48 and the cooled first spent working solution substream S49 are now combined to produce a cooled recombined spent working solution stream S19 having parameters as at a point 19. The pressure, temperature, and composition of the cooled recombined working solution stream S19 are the same as the pressures, temperatures, and compositions of the cooled working solution substreams S48 and S49.

Thereafter, the cooled recombined working solution stream S19 is combined with a higher pressure heated lean solution stream S32 having parameters as at a point 32 as described below to produce a condensing working fluid stream S31 having parameters as at a point 31, corresponding to a state of saturated vapor.

The condensing working fluid stream S31 is now divided into three condensing working fluid substreams S11, S12, and S34 having the parameters as at the points 11, 12, and 34.

The condensing working fluid substream S11 is now sent into and through the third heat exchange unit or exchanger HE3, where it is cooled, condensing and providing heat for the heat exchange process 3-8 as described above to produce the cooled condensing working fluid substream S14 having the parameters as at the point 14, corresponding to a state of vapor-liquid mixture. The temperature of cooled condensing working fluid stream S14 must be higher than a boiling point of the preheated rich basic solution stream S3.

At the same time, the condensing working fluid substream S12 passes into and through the fourth heat exchange unit or exchanger HE4, where it is cooled, condensing and providing heat for the heat exchange process 9-10 as described above to produce the cooled condensing working fluid substream S13 having the parameters as at the point 13, corresponding to a state of vapor-liquid mixture.

At the same time, a first higher pressure first separator lean substream S33 having parameters as at a point 33 is sent into and through a seventh heat exchange unit or exchanger HE7, where it is heated in counterflow by the condensing working fluid substream S34, which is cooled and partially condensed, in a heat exchange process 33-32 or 35-34 as described below to produce a cooled condensing working fluid substream S35 parameters as at point 35, corresponding to a state of vapor-liquid mixture and the heated first higher pressure first separator lean solution stream S32.

The condensing working fluid substreams S13, S14 and S35 are then combined to produce a recombined cooled condensing working fluid stream S21 with parameters as at point 21. The recombined cooled condensing working fluid stream S21 is then sent into a first gravity separator SP1, where the recombined cooled condensing working fluid stream S21 is then divided into a vapor first separator rich stream S22 or S39 having parameters as at a point 22 or 39 corresponding to a state of saturated vapor and a liquid first separator lean stream S23 having parameters as at a point 23 corresponding to a state of saturated liquid.

If the pressure and temperature of the preheated rich basic solution stream S3 having the parameters as at the point 3 is high enough, that a composition of the vapor first separator rich stream S22/S39 having the parameters as at the point 22/39 will be leaner than (i.e., containing a lower proportion of the low-boiling component) or equal to the composition of the rich basic solution stream Si having the parameters as at the point 1. In such a case, the preheated rich basic solution stream S2 will be sent into the second heat exchange unit or exchanger HE2 directly, with no admixture of liquid. Thus, the vapor first separator rich stream S22/S39 having the parameters as at the point 22/39 (upon entry into the second heat exchange unit or exchanger HE2) will be the same as the vapor first separator rich stream S22/S39 having the parameters as at the point 22/39.

The liquid first separator lean stream S23 is then divided into a first liquid first separator lean substream S30 having parameters as at a point 30 and a second liquid first separator lean substream S24 having parameters as at a point 24. The first liquid first separator lean substream S30 is now sent into a fifth pump P5, where its pressure is increased to produce the higher pressure first liquid first separator lean substream S33 having the parameters as at the point 33. The higher pressure first liquid first separator lean substream S33 is now sent into the seventh heat exchange unit or exchanger HE7, where it is heated in counterflow by the condensing working fluid substream S34 in the heat exchange process 34-35 see described above to produce the heated first higher pressure first separator lean substream S32.

Meanwhile, the second liquid first separator lean substream S24 and is sent into an auxiliary or second feed pump P2, where its pressure is increased to a pressure equal to the pressure at the higher pressure basic lean solution stream S9 to produce a higher pressure second liquid first separator lean substream S43 having parameters as at a point 43.

At the same time, the vapor first separator rich stream S22/S39 passes through the second heat exchange unit or exchanger HE2, where it is further condensed and cooled, providing heat for the heat exchange process 2-3 as described above to produce the condensing first separator rich stream S25, corresponding to a state of vapor-liquid mixture.

If the composition of the vapor at the temperature and pressure of the condensing first separator rich stream S25 having the parameters as at the point 25 is still leaner than the composition at the fully condensed basic rich solution stream S1 having the parameters as at the point 1, then the condensing first separator rich stream S25 is sent into and through a pre-condenser HE1*a*, where it is further condensed and cooled in counterflow with a heated coolant stream S52 having parameters as at a point 52 (usually water) in a heat exchange process 52-53 or 25-29 as described below to produce a partially condensed first separator rich stream S29 having parameters as at a point 29 and a spent coolant stream S53 having parameters as at a point 53.

The temperature of the partially condensed first separator rich stream S29 having the parameters as at the point 29 is chosen in such a way that the concentration of vapor in the partially condensed first separator rich stream S29 is equal to or higher than the concentration of vapor in the fully condensed basic rich solution stream Si.

The partially condensed first separator rich stream S29 now enters into a third gravity separator SP3, where it is separated into a vapor third separator rich stream S26 having parameters as at a point 26, corresponding to a state of saturated vapor and a liquid third separator lean stream S40 having parameters as at point 40 corresponding to a state of saturated liquid.

The third liquid separator lean stream S40 is then divided into a first liquid third separator lean substream S41 having parameters as at a point 41 and a second liquid third separator lean substream S42 having parameters as at a point 42. If the composition of the vapor third separator rich stream S26 is equal to the composition of the stream Si, then the flow rate of the first liquid third separator lean substream S41 is zero and the vapor third separator rich stream S26 is redesignated as a vapor third separator rich stream S27 and is sent into a final condenser HE1*b* and the stream S40 is redesignated as a stream S42 point 42 as described below. Alternately, if the composition of the stream S26 is richer than the fully condensed basic rich solution stream Si, the flow rate of the first liquid third separator lean substream S41 is non-zero and is mixed with the vapor third separator rich stream S26 to produce a mixed third separator stream S27 having parameters as at a point 27 corresponding to a state of a liquid-vapor mixture. The composition of the stre mixed third separator stream am S27 is the same as the composition of the fully condensed basic rich solution stream S1.

Meanwhile, the second third liquid separator lean substream S42 is sent into a feed or third pump P3, where its pressure is increased to a desired level (equal to the pressure of the basic lean solution stream S9) to produce a higher pressure second liquid third separator lean substream S44 having parameters as at a point 44.

The higher pressure second liquid third separator lean substream S44 is now mixed with the higher pressure liquid first separator lean substream S43 to produce the basic lean solution stream S9, corresponding to a state of subcooled liquid as described above.

The third separator stream S27 is now sent through the final condenser HE1*b*, where it fully condensed to produce the fully condensed basic rich solution stream S1 in counterflow with a coolant stream S51 having parameters as at a point 51 in a heat process 51-52 or 27-1 as described below.

The cycle is closed.

The coolant streams S51-53 comprises a cooling media, which may be water or air, generally water. The cooling media starts as an initial coolant stream S50 having parameters as at a point 50. The initial coolant stream S50 is pumped by a fourth pump P4, to an elevated pressure to produce the higher pressure coolant stream S51 having the parameters as at the point 51.

The higher pressure coolant stream 51 is now sent into the final condenser HE1*b*, where it cools the third separator stream S27 in the heat exchange process 27-1 to produce the heated higher pressure coolant stream S52 having the parameters as at the point 52.

The heated higher pressure coolant stream S52 then passes through the condenser HE1*a* cooling the condensing first separator rich stream S25 in the heat exchange process 25-29 to produce the spent coolant stream S53 having the parameters as at the point 53, where it exits the system.

The heat source stream S500 used in the heat exchange process 500-502 may be flue gas from a combustor, or may be a stream of any fluid with adequate temperature and flow rate. The heat source stream S500 having the parameters as at the point 500 is then sent into and through the HRVG, providing heat for the heat processes 45-15 and 6-16 to produce a cooled heat source stream S502 having the parameters as at the point 502.

If an initial heat source stream S600 having parameters as at a point 600 has a temperature that is too high for the heat exchange process 500-502 in the HRVG, the cooled heat source stream S502 is divided into a first cooled heat source substream S509 having parameters as at a point 509 and a second cooled heat source substream S550 having parameters as at a point 550.

The first cooled heat source substream S509 is then sent into a circulation fan F4, where its pressure is slightly increased to produce an increased pressure cooled heat source stream S510 having parameters as at a point 510. The increased pressure cooled heat source stream S510 is then mixed with the initial heat source stream S600 to produce a heat source stream S575 having parameters as at a point 575, which has an acceptable lower temperature.

In such a case, the heat source stream S575 is a flue gas, it may carry particle of burned fuel and/or ash from the combustor. In that case, the heat source stream S575 is now sent into a cyclone separator C, where the particles and/or ash are separated from the flue gas as the heat source stream exits the cyclone separator C to produce the heat source stream S500 having the parameters as at the point 500.

In the case that there are no such particles of fuel and/or ash, then stream source stream S575 is redesignated as the heat source stream S500 and the cyclone separator C may be omitted from the system.

Meanwhile, the second cooled heat source substream S550 may be returned to the combustor, where it may be utilized for such purposes as the preheating of air, or to be reheated and returned to the system as the initial heat source stream S600 having the parameters as at the point 600.

PS Variants

The system described above corresponds to the case where a temperature and a pressure of the preheated higher pressure basic rich solution stream S3 having the parameters as at the point 3 is high enough that the composition at point 22 is leaner than at point 1.

If, on the other hand, the inlet pressure of the working solution stream S17 having the parameters as at the point 17 (at the inlet of the turbine) and the corresponding pressure and temperature of the preheated higher pressure basic rich solution stream S3 having the parameters as at the point 3 are lower, then the composition of the vapor first separator rich stream S22 having the parameters as at the point 22 will become relatively richer. As a result, after being cooled in the second heat exchange unit or exchanger HE2, the temperature of the condensing first separator rich stream S25 having the parameters as at the point 25 may be low enough that the concentration of vapor in at the condensing first separator rich stream S25 may be richer than or equal to the concentration of vapor in fully condensed basic rich solution stream S1.

In such a case, the condensing first separator rich stream S25 may be sent directly into the third separator SP3, omitting the pre-condenser HE1*a* from the system. Note that if the pre-condsenser HE1*a* is not used, then the cooled coolant stream S52 as described above will exit the system as shown in FIG. 3 and designated CS-21k5 Variant B.

Alternately, if the pressure and the temperature of the preheated rich basic solution stream S3 having the parameters as at the point 3 are lower, then the composition of the vapor first separator rich stream S22 having the parameters as at the point 22 is richer the composition of the rich basic solution stream S1 having the parameters as at the point 1, then the structure of the system will may be slightly changed. In such a case, the first liquid lean stream S23 having the parameters as at the point 23 will be divided to produce a saturated lean liquid substream S28 having parameters as at a point 28 and the saturated lean liquid stream S24. The saturated lean liquid substream S28 will be mixed with the vapor first separator rich stream S22 to produce a modified stream S39 having parameters as at the point 39. The modified stream S39 will has a composition that is the same as the composition of the rich basic solution stream S1 having the parameters as the at the point 1 as shown in FIG. 4, designated as CS-21k5 Variant C.

Meanwhile, the lean liquid first separator stream S23 exiting the first separator SP1 is now divided into a first lean liquid first separator substream S24 having parameters as at a point 24 and a second lean liquid first separator substream S30 having parameters as at a point 30. Alternately, as in the case described as CS-21k5 Variant C as described above and shown in FIG. 4, the lean liquid first separator stream S23 is divided into three substreams, adding stream 28 [see above.])

If the pressure and temperature of the preheated rich basic solution stream S3 having the parameters as at the point 3 are even lower than the above case, the concentration of vapor at point 22 may become richer than or equal to the composition of the rich basic solution stream S1.

Figure 4:
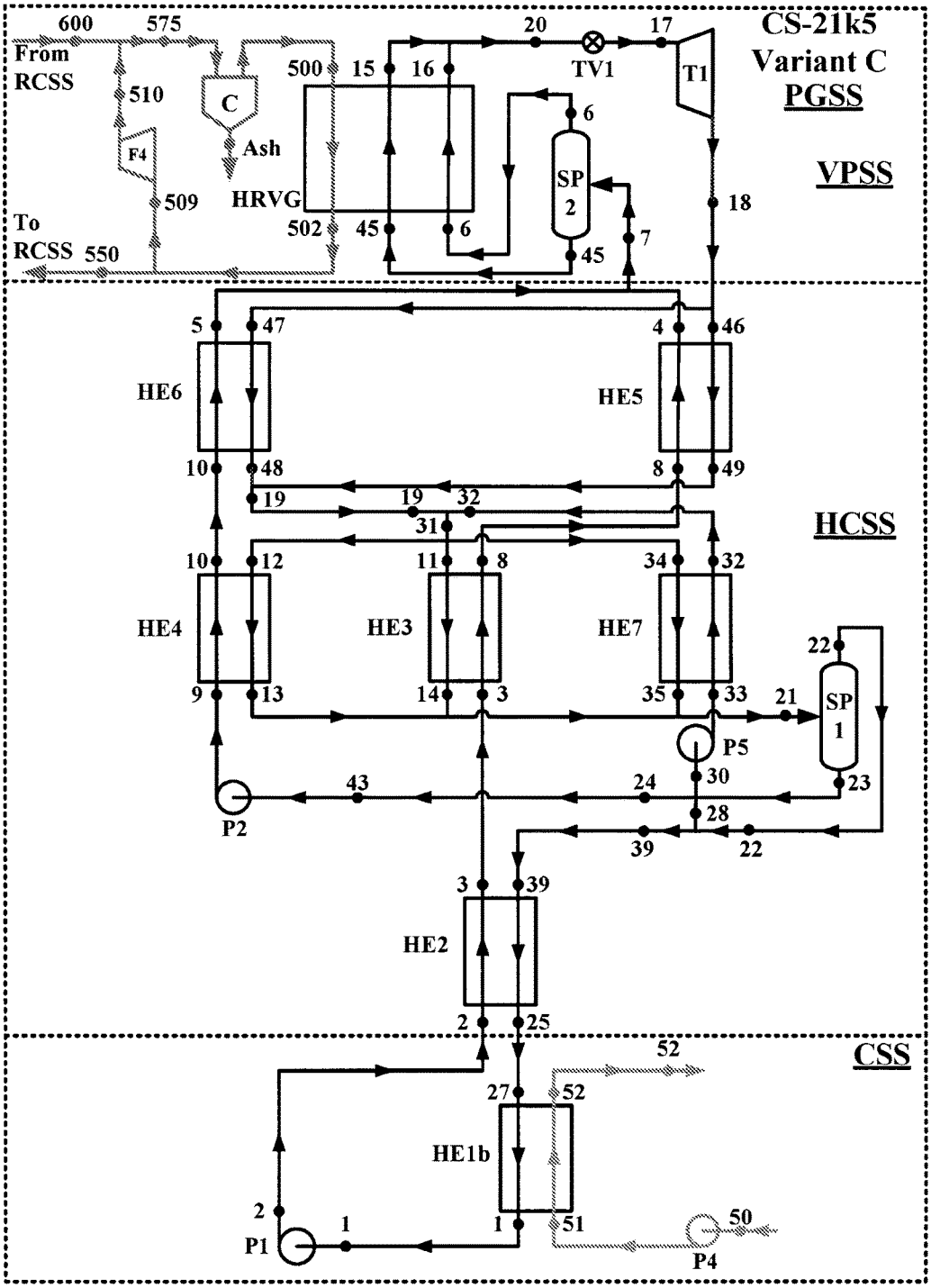
FIG. 4 depicts a second variant of the embodiment of FIG. 1 designated CS-21k5 Variant C.

In this variant designated CS-21k5 Variant C, then the pre-condenser HE1*a* and the third separator SP3 are omitted as shown in FIG. 4.

Note that, the higher the pressure of the working solution stream S17, the lower the temperature of the spent working solution stream S18. Thus, if the pressure of the working solution stream S17 is high enough, then the temperature of the spent working solution stream S18 may be so low that it becomes equal to the temperature of the cooled recombined spent working solution stream S19 as described above.

Likewise, note that for any given temperature of condensing working fluid stream S31, the higher the consequent temperature of the higher pressure heated lean solution stream S32, the lower the temperature of the cooled recombined spent working solution stream S19, and vice versa. This allows the variation of the parameters of the cooled recombined spent working solution stream S19 (within certain limits) and thus to make the parameters of the cooled recombined spent working solution stream S19 equal to those of the spent working solution stream S18.

Figure 5:
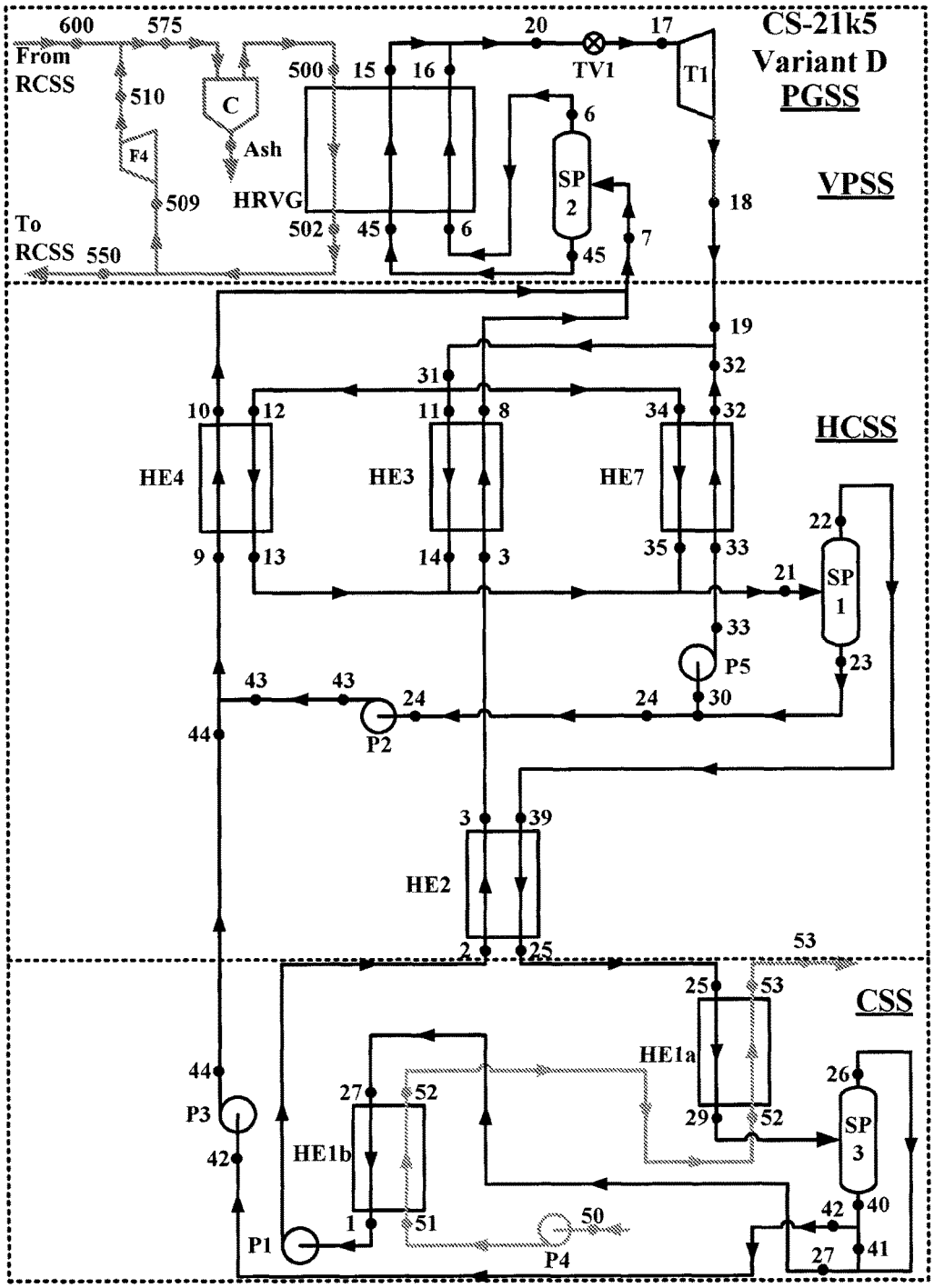
FIG. 5 depicts a third variant of the embodiment of FIG. 1 designated CS-21k5 Variant D.

In such a case, the fifth heat exchange unit HE5 and the sixth heat exchange unit HE6 are not needed and may be omitted. The spent working solution stream S18 will correspond to the cooled recombined spent working solution stream S19, and the parameters of the superheated higher pressure basic rich solution stream S4 become the same as the heated higher pressure basic rich solution stream S8, while the parameters of the heated basic lean solution stream S5 become the same as the heated basic lean solution stream S10 as shown in FIG. 5 and designated CS-21k5 Variant D.

The choice of pressure of the working solution stream S17 is dictated by engineering and economic considerations and the optimal pressure is chosen for optimal overall performance. One experienced in the art can select an optimum pressure for any given considerations.

Table of Streams and Stream Names

| Stream Designation | Stream Name |
|---|---|
| S1 | fully condensed basic rich solution stream |
| S2 | higher pressure fully condensed basic rich solution stream |
| S3 | preheated higher pressure basic rich solution stream |
| S4 | superheated higher pressure basic rich solution stream |
| S5 | heated basic lean solution stream |
| S6 | second vapor separator rich stream |
| S7 | working solution stream |
| S8 | heated higher pressure basic rich solution stream |
| S9 | basic lean solution stream |
| S10 | heated basic lean solution stream |
| S11 | condensing working fluid substream |
| S12 | condensing working fluid substream |
| S13 | cooled condensing working fluid substream |
| S14 | cooled condensing working fluid substream |
| S15 | superheated second vapor separator lean stream |
| S16 | superheated vapor second vapor separator rich stream |
| S17 | working solution stream |
| S18 | spent working solution stream |
| S19 | cooled recombined spent working solution stream |
| S20 | recombined working solution stream |
| S21 | recombined cooled condensing working fluid stream |
| S22 | first vapor separator rich stream |
| S23 | first liquid separator lean stream |
| S24 | second liquid separator lean substream |
| S25 | condensing first separator rich stream |
| S26 | third vapor separator rich stream |
| S27 | third vapor separator rich stream or mixed third separator stream |
| S28 | third liquid separator lean substream |
| S29 | partially condensed first separator rich stream |
| S30 | first liquid separator lean substream |
| S31 | condensing working fluid stream |
| S32 | higher pressure heated lean solution stream |
| S33 | higher pressure lean solution stream |
| S34 | condensing working fluid substream |
| S35 | cooled condensing working fluid substream |
| S39 | first vapor separator rich stream |
| S40 | third liquid separator lean stream |
| S41 | first third liquid separator lean substream |
| S42 | second third liquid separator lean substream |
| S43 | higher pressure liquid first separator lean substream |
| S44 | higher pressure second third liquid separator lean substream |
| S45 | second liquid separator lean stream |
| S46 | first spent working solution substream |
| S47 | second spent working solution substream |
| S48 | cooled second spent working solution substream |
| S49 | cooled first spent working solution substream |
| S50 | initial coolant stream |
| S51 | higher pressure coolant stream |
| S52 | heated higher pressure coolant stream |
| S53 | spent coolant stream |
| S600 | initial heat source stream |
| S575 | mixed heat source stream |
| S500 | heat source stream |

-continued

| Table of Streams and Stream Names | |
|---|---|
| Stream Designation | Stream Name |
| S502 | cooled heat source stream |
| S509 | first cooled heat source substream |
| S510 | higher pressure first cooled heat source substream |
| S550 | second cooled heat source substream |

| Table of Stream Compositions | |
|---|---|
| Stream Designations | Stream Compositions |
| S7, S20, S17, S18, S46, S47, S48, S49 & S19 | working solution streams |
| S6 & S16 | second separator rich streams |
| S45 & S15 | second separator lean streams |
| S31, S11, S12, S34, S13, S14, S35 & S21 | condensing working fluid streams |
| S22, S39, S25 & S29 | first separator rich streams |
| S23, S24, S28, S30, S32, S33 & S43 | first separator lean streams |
| S26 | third separator rich streams |
| S40, S41, S42 & S44 | third separator lean streams |
| S27, S1, S2, S3, S8 & S4 | basic rich solution streams |
| S9, S10 & S5 | basic lean solution stream |

Recuperative Combustion Subsystem (RCSS)

The systems of this invention may operate very efficiently in combination with the recuperative combustor designation RCSS described in U.S. Pat. No. 7,350,471 and shown in FIGS. 6A&B, where the power system (PS) in as described above. RCSS generates the heat source stream S600 for use in the PGSS of this invention.

Figure 6A:
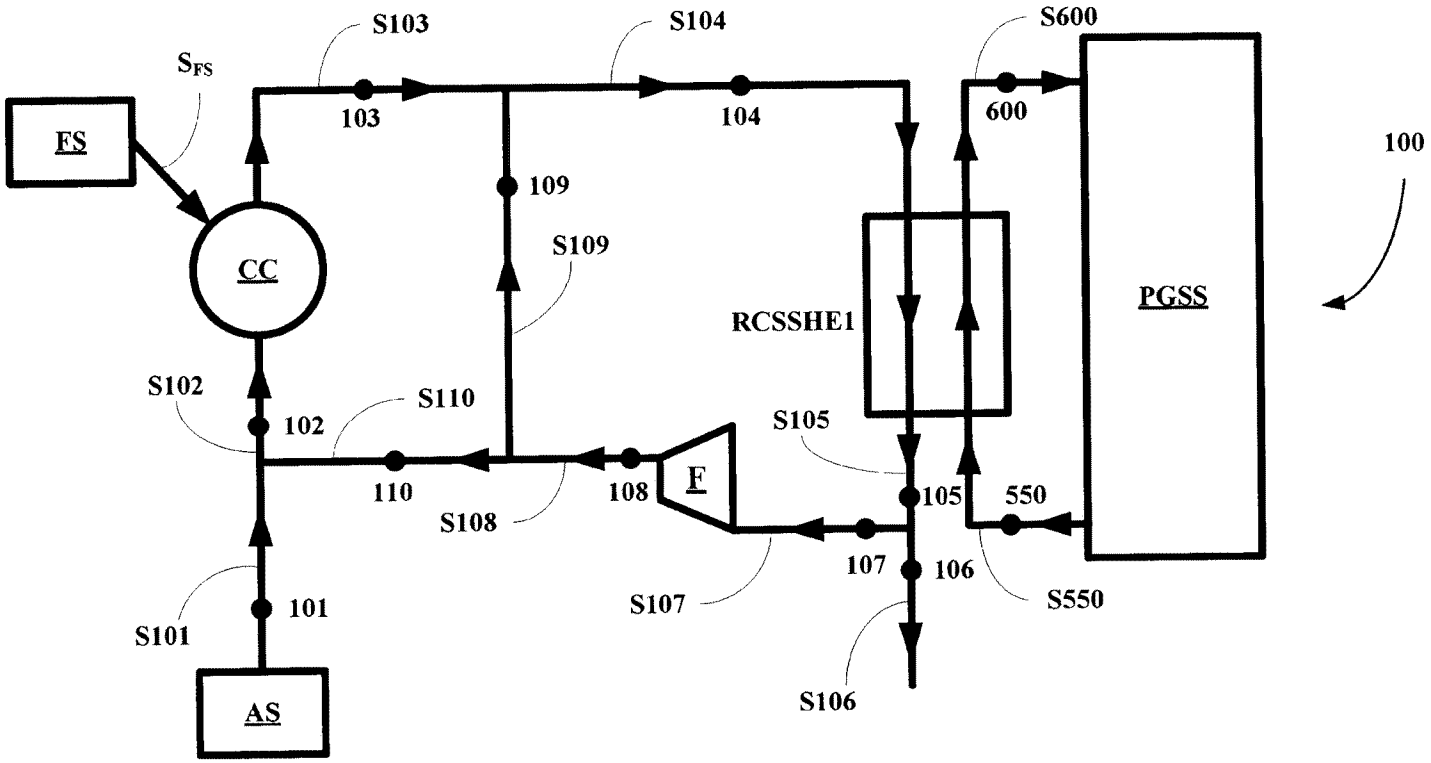
FIG. 6A depicts an embodiment of a combustion apparatus of this invention feeding a power supply system of this invention.

Referring now to FIG. 6A, a recuperative combustion apparatus, generally 100, is shown, which may be used in conjunction with the power system (PS) of this invention. An air stream S101 having parameters as at a point 101 enters into the system 100, which may be atmospheric air.

The air stream S101 having the parameters as at the point 101 is then mixed with a second higher pressure, cooled flue gas substream S110 having parameters as at a point 110 as described below to produce an air-flue gas mixed stream S102 having parameters as at a point 102. A flow rate of the air stream S101 having the parameters as at the point 101 from an air source AS (generally the atmosphere) is chosen in such a way as to provide a desired amount of excess air for the combustion process, generally a sufficient quantity of air to substantially completely combust or oxidize the fuel. It is evident that the quantity of oxygen in the mixed stream S102 having the parameters as at the point 102 contains all of the oxygen that was present in the air stream S101 having the parameters as at the point 101, and therefore, has sufficient oxygen content to support the combustion of the fuel being combusted in the combustion process. The mixed stream S102 is then fed into a combustion chamber CC.

At the same time, a fuel stream $S_{FS}$ is fed into the combustion chamber CC and combustion takes place inside the combustion chamber CC where oxygen in the mixed stream S102 oxidized or combusts of the fuel in the fuel stream $S_{FS}$. The combustion chamber CC for use in this invention may be any unit that is now used or is yet to be invented for oxidizing a fuel in air to generate heat in the form of an exhaust or flue gas. If the air stream S102 having the parameters as at the point 102 were to have been sent into the combustion chamber CC directly, then the heat released in the combustion process would heat the produced flue gas to an unacceptable high temperature. But because the second higher pressure, cooled flue gas substream S110 having the parameters as at the point 110 has been added to the air stream S102 having the parameters as at the point 102, the heat produced in the combustion chamber CC must heat a substantially higher quantity of gas. As a result, a temperature achieved in the combustion chamber CC will be substantially reduced. By varying the flow rate of the mixed stream S102 having the parameters as at the point 102, it is possible to control the temperature in the combustion chamber CC. In this way, the first goal of the RCSS is achieved, i.e., control and reduce the temperature in the combustion chamber CC.

However, the temperature in the combustion chamber CC must still be maintained at a relatively high temperature to provide for an effective combustion of the fuel. Substantially all of the heat released in the combustion process is accumulated in a flue gas stream S103 having parameters as at a point 103 that leaves the combustion chamber CC. A temperature of the flue gas stream S103 having the parameters as at the point 103 is still too high for this gas to be directly sent into the HRVG of the PGSS as described above in the power system of this invention. Therefore, the flue gas stream S103 having the parameters as at the point 103 is mixed with a first higher pressure, cooled flue gas substream S109 having parameters as at a point 109 forming a reduced temperature flue gas steam S104 having parameters as at point 104. A flow rate of the first higher pressure, cooled flue gas substream S109 having the parameters as at the point 109 is chosen in such a way that a temperature of the reduced temperature flue gas stream S104 having the parameter as at the point 104 is suitable for direct utilization in the HRVG of the PGSS of this invention.

The reduced temperature flue gas steam S104 having the parameters as at the point 104 is then sent into and through a first RCSS heat exchange unit or exchanger RCSSHE1, where it transfers its heat to second cooled heat source substream S550 having the parameters as at the point 550 in a heat exchange process 104-105 or 550-600. The heat exchange process 104-105 or 550-600 produces a cooled flue gas stream S105 having parameters as at a point 105 and initial heat source stream S600 having the parameters as at the point 600. A temperature of the spent flue gas stream S105 having the parameters as at the point 105 corresponds to a lowest temperature of the HRVG of the PGSS of the power system PS as described above.

Thereafter, the cooled flue gas stream S105 having the parameters as at the point 105 is divided into a first cooled flue gas substream S106 having parameters as at a point 6 and a second cooled flue gas substream S107 having parameters as at a point 7. The first cooled flue gas substream S106 having the parameters as at the point 6 now exits the RCSS. The second cooled flue gas substream S107 having the parameters as at the point 7 now enters into a circulating fan F, where its pressure is increased to a pressure needed to overcome a hydraulic resistance of the combustion chamber CC and the first RCSS heat exchanger RCSSHE1 to produce a higher pressure, cooled flue gas stream S108 having parameters as at a point 108. Thereafter, the higher pressure, cooled flue gas stream S108 having the parameters as at the point 108 is divided into the first higher pressure, cooled flue gas substream S109 having the parameters as at the point 109 and the second higher pressure, cooled flue gas substream S110 having the parameters as at the point 110.

The second higher pressure, cooled flue gas substream S110 having the parameters as at the point 110 is then mixed with the stream S101 of incoming air having the parameters as at the point 101, thus forming the mixed air/flue gas stream S102 having the parameters as at the point 102 as described above.

Meanwhile, the first higher pressure, cooled flue gas substream S109 having the parameters as at the point 109 is mixed with the hot flue gas stream S103 having the parameters as at the point 103 forming the reduced temperature flue gas stream S104 having the parameters as at the point 104 as described above.

Figure 6B:
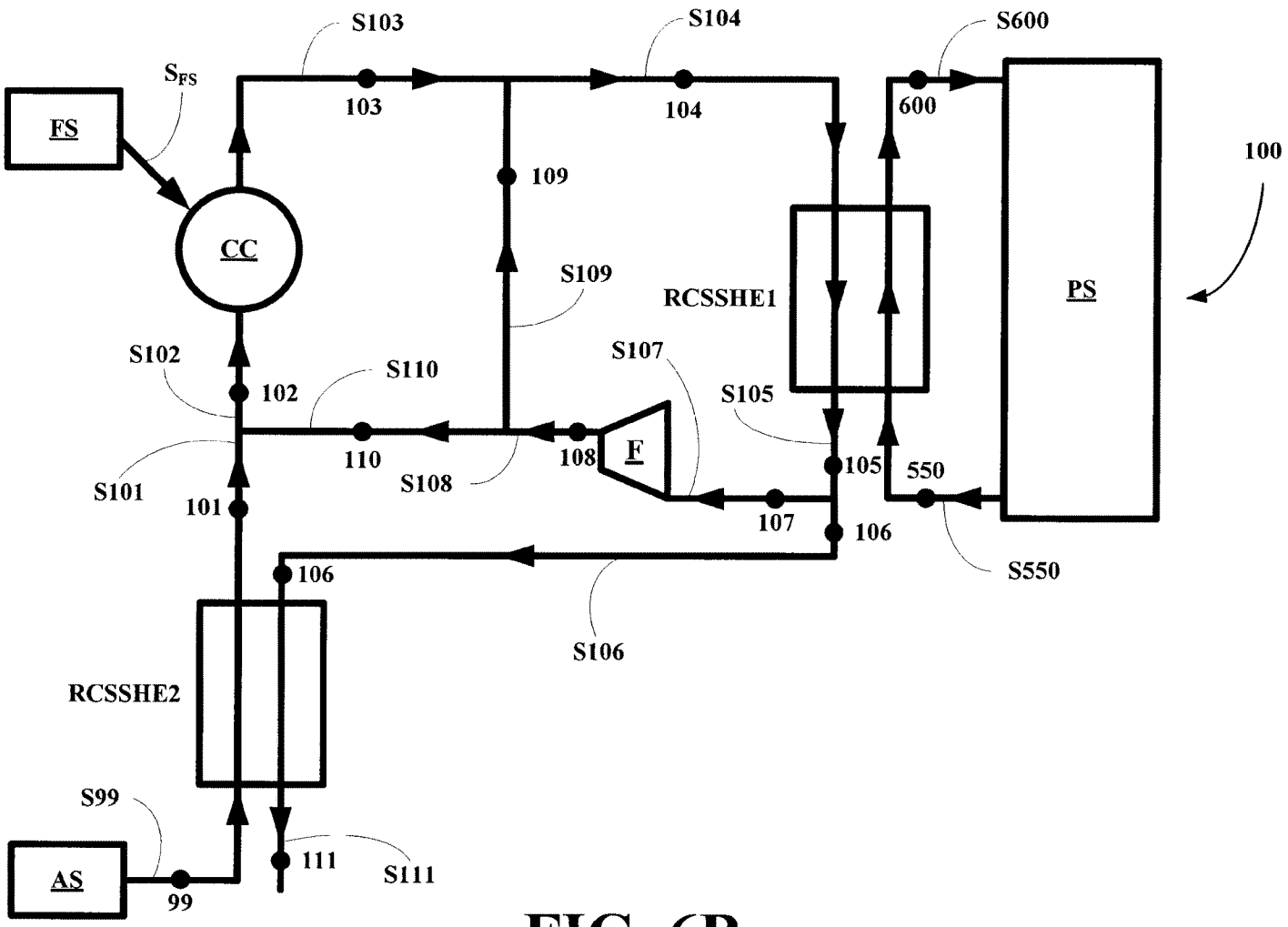
FIG. 6B depicts another embodiment of a combustion apparatus of this invention feeding a power supply system of this invention.

Referring now to FIG. 6B, another recuperative combustion apparatus, generally 100, is shown, which may be used in conjunction with the power system (PS) of this invention. A precursor air stream S99 having parameters as at a point 99, which may be atmospheric air from the air source AS is sent into and through a second RCSS heat exchange unit or exchanger RCSSHE2 to from a heated air stream S101 having parameters as at a point 101.

The heated air stream S101 having the parameters as at the point 101 is then mixed with a second higher pressure, cooled flue gas substream S110 having parameters as at a point 110 as described below to produce an air-flue gas mixed stream S102 having parameters as at a point 102. A flow rate of the air stream S101 having the parameters as at the point 101 from an air source AS (generally the atmosphere) is chosen in such a way as to provide a desired amount of excess air for the combustion process, generally a sufficient quantity of air to substantially completely combust or oxidize the fuel. It is evident that the quantity of oxygen in the mixed stream S102 having the parameters as at the point 102 contains all of the oxygen that was present in the air stream S101 having the parameters as at the point 101, and therefore, has sufficient oxygen content to support the combustion of the fuel being combusted in the combustion process. The mixed stream S102 is then fed into a combustion chamber CC.

At the same time, a fuel stream $S_{FS}$ is fed into the combustion chamber CC and combustion takes place inside the combustion chamber CC where oxygen in the mixed stream S102 oxidized or combusts of the fuel in the fuel stream $S_{FS}$. The combustion chamber CC for use in this invention may be any unit that is now used or is yet to be invented for oxidizing a fuel in air to generate heat in the form of an exhaust or flue gas. If the air stream S102 having the parameters as at the point 102 were to have been sent into the combustion chamber CC directly, then the heat released in the combustion process would heat the produced flue gas to an unacceptable high temperature. But because the second higher pressure, cooled flue gas substream S110 having the parameters as at the point 110 has been added to the air stream S102 having the parameters as at the point 102, the heat produced in the combustion chamber CC must heat a substantially higher quantity of gas. As a result, a temperature achieved in the combustion chamber CC will be substantially reduced. By varying the flow rate of the mixed stream S102 having the parameters as at the point 102, it is possible to control the temperature in the combustion chamber CC. In this way, the first goal of the RCSS is achieved, i.e., control and reduce the temperature in the combustion chamber CC.

However, the temperature in the combustion chamber CC must still be maintained at a relatively high temperature to provide for an effective combustion of the fuel. Substantially all of the heat released in the combustion process is accumulated in a flue gas stream S103 having parameters as at a point 103 that leaves the combustion chamber CC. A temperature of the flue gas stream S103 having the parameters as at the point 103 is still too high for this gas to be directly sent into the HRVG of the PGSS as described above in the power system of this invention. Therefore, the flue gas stream S103 having the parameters as at the point 103 is mixed with a first higher pressure, cooled flue gas substream S109 having parameters as at a point 109 forming a reduced temperature flue gas steam S104 having parameters as at point 104. A flow rate of the first higher pressure, cooled flue gas substream S109 having the parameters as at the point 109 is chosen in such a way that a temperature of the reduced temperature flue gas stream S104 having the parameter as at the point 104 is suitable for direct utilization in the HRVG of the PGSS of this invention.

The reduced temperature flue gas steam S104 having the parameters as at the point 104is then sent into and through a heat exchange unit or exchanger RCSSHE1, where it transfers its heat to second cooled heat source substream S550 having the parameters as at the point 550 in a heat exchange process 104-105 or 550-600. The heat exchange process 104-105 or 550-600 produces a cooled flue gas stream S105 having parameters as at a point 105 and initial heat source stream S600 having the parameters as at the point 600. A temperature of the spentflue gas stream S105 having the parameters as at the point 105 corresponds to a lowest temperature of the HRVG of the PGSS of the power system PS as described above.

Thereafter, the cooled flue gas stream S105 having the parameters as at the point 105 is divided into a first cooled flue gas substream S106 having parameters as at a point 106 and a second cooled flue gas substream S107 having parameters as at a point 107. The second cooled flue gas substream S107 having the parameters as at the point 107 now enters into a circulating fan F, where its pressure is increased to a pressure needed to overcome a hydraulic resistance of the combustion chamber CC and the first RCSS heat exchanger RCSSHE1 to produce a higher pressure, cooled flue gas stream S108 having parameters as at a point 108. Thereafter, the higher pressure, cooled flue gas stream S108 having the parameters as at the point 108 is divided into the first higher pressure, cooled flue gas substream S109 having the parameters as at the point 109 and the second higher pressure, cooled flue gas substream S110 having the parameters as at the point 110.

The second higher pressure, cooled flue gas substream S110 having the parameters as at the point 110 is then mixed with the stream S101 of incoming air having the parameters as at the point 101, thus forming the mixed air/flue gas stream S102 having the parameters as at the point 102 as described above.

Meanwhile, the first higher pressure, cooled flue gas substream S109 having the parameters as at the point 109 is mixed with the hot flue gas stream S103 having the parameters as at the point 103 forming the reduced temperature flue gas stream S104 having the parameters as at the point 104 as described above.

The first cooled flue gas substream S106 having the parameters as at the point 106 is utilized to preheat the precursor air stream S99 having the parameters as at the point 99 in a pre-heater or second RCSS heat exchanger RCSSHE2 forming the air stream S101 having the parameters as at the point 101, with is now heated, and a spent flue gas stream S111 having parameter as at a point 111, which then exits the RCSS.

It is clear that recirculation of the flue gas stream S107 having the parameters as at the point 107 through the combustion chamber CC and the first RCSS heat exchanger RCSSHE1 of the power generation subsystem PGSS does not reduce the total quantity of heat transferred to the HRVG of the power generation subsystem PGSS. As a result of the recirculation, the temperature difference in the first RCSS heat exchanger RCSSHE1 is reduced. This reduction in turn may cause an increase in the required surface of the heat exchanger. However, because the temperature of the flue gas is reduced, it allows the use of finned tubes in the first RCSS heat exchanger RCSSHE1, which in turn allows for an increase in a surface area at very low extra cost. Moreover, because a flow rate of stream S104 having the parameters as at the point 104 passing though the first RCSS heat exchanger RCSSHE1 is substantially higher than the flow rate of flue gases which would be produced without recirculation. The velocity of the stream S104 inside the first RCSS heat exchange RCSSHE1 is substantially increased, and this, in turn, increases a heat transfer coefficient in the first RCSS heat exchanger RCSSHE1.

Summing up, the recuperative combustion system (RCSS) 100 allows for the effective control of the temperature in the combustion chamber CC and of the temperature of the flue gas entering into the first RCSS heat exchanger RCSSHEL Heat stresses in the tubes of the heat exchanger (s) of the power system are drastically reduced, and instead of a complicated and expensive conventional boiler/combustor systems, a simple combustion chamber and relatively inexpensive HRVG type heat exchanger system.

CONCLUSION

However, it may also operate successfully with other types of combustion system, or with other heat sources including solar-thermal heat sources.

The systems of this invention are suitable for both large scale and small scale applications.

Preliminary calculations have shown that the systems of this invention may achieve a net thermal efficiency of up to about 38.6%, which is greater than or comparable to the thermal efficiency of current base load utility power plants, which have a maximum thermal efficiency of approximately 37%. In other embodiments, the systems may achieve a net thermal efficiency of up to about 39%In other embodiments, the systems may achieve a net thermal efficiency of up to about 40%.

I claim:

1. A process for generating power comprising:

providing a heat source stream to a power generation subsystem (PGSS) of a power system (PS) from a heat source subsystem (HSSS) including a heat source producing an initial heat source stream, wherein the PGSS comprises a vaporization and power generation subsystem (VPSS) including a heat recovery vapor generator (HRVG) and a turbine T1, a heating and cooling subsystem (HCSS) including three parallel configured heat exchange units HE3, HE4, and HE7, a single heat exchange unit HE2, and a first separator SP1, and a condensing subsystem (CSS) including a final condenser HE1b, wherein the heat source stream is derived from the initial heat source stream, vaporizing and superheating a working solution stream in the HRVG using heat from the heat source stream to form a vaporized and superheated working solution stream and converting a portion of the heat associated with the vaporized and superheated working solution stream in the turbine T1 into a usable form of energy comprising mechanical and/or electrical energy in the VPSS producing a spent working solution stream, heating, cooling, separating, and combining streams derived from the spent working fluid stream to optimize utilization of residual heat in the spent working fluid stream in the heating and cooling subsystem HCSS to produce a condensing stream, and condensing the condensing stream in a condensing subsystem CSS using a coolant stream to form a fully condensed basic rich solution stream, which is sent back into the HCSS to be heated with heat from or derived from the spent working fluid stream prior to entering the VPSS, wherein the streams used in the three parallel configured heat exchange units HE3, HE4, and HE7 are derived from the fully condensed base rich solution stream from the CSS and the spent working solution stream from the VPSS and no external streams.

2. The process of claim 1, wherein:

the VPSS further includes a throttle control valve TV1, the vaporizing and superheating step comprises:

pressure adjusting the vaporized and superheated working solution stream in the throttle control valve TV1 to form a pressure adjusted, vaporized and superheated working solution stream, and converting a portion of heat in the pressure adjusted, vaporized and superheated working solution stream in the turbine T1 to form the spent working fluid stream.

3. The process of claim 2, wherein:

the VPSS further includes a second separator SP2, the vaporizing and superheating step comprises:

separating the working solution stream in the a second separator SP2 into a rich vapor stream and a lean liquid stream, vaporizing and superheating the rich vapor stream in the HRVG to form a vaporized and superheated rich stream, vaporizing and superheating the lean liquid stream in the HRVG to form a vaporized and superheated lean stream, combining the vaporized and superheated rich stream and the vaporized and superheated lean stream to the vaporized and superheated working solution stream, and converting a portion of heat in the pressure adjusted, vaporized and superheated working solution stream in the turbine T1 to form the spent working fluid stream.

4. The process of claim 1, wherein:

the VPSS further includes a throttle control valve TV1 and a second separator SP2, the vaporizing and superheating step comprises:

separating the working solution stream in the a second separator SP2 into a rich vapor stream and a lean liquid stream, vaporizing and superheating the rich vapor stream in the HRVG to form a vaporized and superheated rich stream, vaporizing and superheating the lean liquid stream in the HRVG to form a vaporized and superheated lean stream, combining the vaporized and superheated rich stream and the vaporized and superheated lean stream to the vaporized and superheated working solution stream, pressure adjusting the vaporized and superheated working solution stream in the throttle control valve TV1 to form a pressure adjusted, vaporized and superheated working solution stream, and converting a portion of heat in the pressure adjusted, vaporized and superheated working solution stream in the turbine T1 to form the spent working fluid stream.

5. The process of claim 1, wherein the vaporizing and superheating step comprises:

combining the initial heat source stream with a higher pressure, cooled heat source substream to form a mixed heat source stream, using the mixed heat source stream as the heat source for the heat recovery vapor generator HRVG to produce a cooled heat source stream, dividing the cooled heat source stream into a first cooled heat source substream and a second cooled heat source substream, pressurizing the second cooled heat source substream in a fan to from the higher pressure, cooled heat source substream, and sending the first cooled heat source substream out of the PS.

6. The process of claim 5, wherein the vaporizing and superheating step comprises:

sending the mixed heat source stream into a cyclone separator C to remove any particulate material in the mixed heat source stream to form a substantially particulate free or particulate free heat source stream, and using the substantially particulate free or particulate free heat source stream as the heat source stream for the heat recovery vapor generator HRVG.

7. The process of claim 1, further comprising:

feeding a fuel stream and a mixed air flue gas stream into a combustor to form a hot flue gas stream, combining the hot flue gas stream with a first higher pressure, cooled flue gas substream to form a reduced temperature flue gas steam, transferring heat from the reduced temperature flue gas steam to the spent heat source stream from the HRVG to produce the initial heat source stream and a cooled flue gas stream, dividing the cooled flue gas stream into a first cooled flue gas substream and a second cooled flue gas substream, pressurizing the second cooled flue gas substream in a fan to produce a higher pressure, cooled flue gas stream, dividing higher pressure, cooled flue gas stream into a first higher pressure, cooled flue gas substream and a second higher pressure, cooled flue gas sub stream, and combining the second higher pressure, cooled flue gas sub stream with an air stream to from the mixed air flue gas stream.

8. The process of claim 1, wherein:

the HCSS further includes a second pump P2 and a fifth pump P5, the CSS further includes a precondenser HE1*a*, a first pump P1, a third pump P3, and a third separator SP3, the heating, cooling, separating, and combining step comprises:

combining the spent working solution stream with a first higher pressure, heated first separator lean substream to form a condensing working fluid stream, dividing the condensing working fluid stream into a first condensing working fluid substream, a second condensing working fluid substream, and a third condensing working fluid substream, simultaneously transferring: a) heat from the first condensing working fluid substream to a preheated, higher pressure, basic rich solution stream in one of the three parallel configured heat exchange units HE3 to form a vaporized or partially vaporized, higher pressure, basic rich solution stream and a cooled first condensing working fluid substream, b) heat from the second condensing working fluid substream to a higher pressure, basic lean solution stream in a second of the three parallel configured heat exchange units HE4 to form a partially vaporized, higher pressure basic lean solution stream and a cooled second condensing working fluid substream, and c) heat from the third condensing working fluid substream to a first higher pressure, first separator lean substream in a third of the three parallel configured heat exchange units HE7 to form the first higher pressure, heated first separator lean substream and a cooled third condensing working fluid substream, combining the cooled first condensing working fluid substream, the cooled second condensing working fluid substream and the cooled third condensing working fluid substream to form a combined working fluid stream, separating the combined working fluid stream in the first separator SP1 to form a vapor first separator rich stream and a liquid first separator lean stream, dividing the liquid first separator lean stream into the first liquid first separator lean substream and a second liquid first separator lean substream, pressurizing the first liquid first separator lean substream in the fifth pump P5 to form the higher pressure, first liquid first separator lean substream, transferring heat form the vapor first separator rich stream to a higher pressure, basic rich solution stream in the single heat exchange unit HE2 to form the preheated, higher pressure, basic rich solution stream and a cooled first separator rich stream, pressurizing the second liquid first separator lean substream in the second pump P2 to form a higher pressure, second liquid first separator lean substream, combining the higher pressure, second liquid first separator lean substream with a second higher pressure, liquid third separator lean stream to form the higher pressure, basic lean solution stream, and combining the vaporized, higher pressure, basic rich solution stream and the partially vaporized, higher pressure, basic lean solution stream to form the working solution stream;

and the condensing step comprises:

partially condensing the cooled first separator rich stream with a cooled external coolant stream in the precondenser HE1*a* to from a spent external coolant stream and a partially condensed first separator rich stream, separating the partially condensed first separator rich stream in a third separator SP3 to form a vapor third separator rich stream and a liquid third separator lean stream, dividing the liquid third separator lean stream into a first liquid third separator lean substream and a second liquid third separator lean substream, pressurizing the second liquid third separator lean substream in the third pump P3 to form the second higher pressure, liquid third separator lean substream, combining the vapor third separator rich stream with the first liquid third separator lean substream to form a basic rich solution stream, condensing the basic rich solution stream in the final condenser HE1*b* with a coolant stream to form a fully condensed, basic rich solution stream and the cooled coolant stream, and pressurizing the fully condensed, basic rich solution stream in the first pump P1 to form the higher pressure, fully condensed, basic rich solution stream.

9. The process of claim 8, further comprising:

feeding a fuel stream and a mixed air flue gas stream into a combustor to form a hot flue gas stream, combining the hot flue gas stream with a first higher pressure, cooled flue gas substream to form a reduced temperature flue gas steam, transferring heat from the reduced temperature flue gas steam to the spent heat source stream from the HRVG to produce the initial heat source stream and a cooled flue gas stream, dividing the cooled flue gas stream into a first cooled flue gas substream and a second cooled flue gas substream, pressurizing the second cooled flue gas substream in a fan to produce a higher pressure, cooled flue gas stream, dividing higher pressure, cooled flue gas stream into a first higher pressure, cooled flue gas substream and a second higher pressure, cooled flue gas sub stream, and combining the second higher pressure, cooled flue gas sub stream with an air stream to from the mixed air flue gas stream.

10. The process of claim 1, wherein:

the HCSS further includes two parallel configured heat exchange units HE5 and HE6, a second pump P2, and a fifth pump P5, the CSS further includes a first pump P1, the vaporizing and superheating step comprises:

dividing the spent working solution stream into a first spent working solution substream and a spent working solution substream, simultaneously transferring: a) heat from the first spent working solution substream to a heated preheated, higher pressure, basic rich solution stream in one of the two parallel configured heat exchange units HE5 to form a vaporized or superheated, higher pressure, basic rich solution stream and a cooled first spent working solution substream, and b) heat from the second spent working solution substream to a heated, higher pressure, basic lean solution stream in a second of the two parallel configured heat exchange units HE6 to form a partially vaporized, higher pressure, basic lean solution stream and a cooled second spent working solution substream, combining the cooled first spent working solution substream with a cooled second spent working solution substream to form a cooled spent working solution stream, combining the cooled spent working solution stream with a first higher pressure, heated first separator lean substream to form a condensing working fluid stream, simultaneously transferring: a) heat from the first condensing working fluid substream to a preheated, higher pressure, basic rich solution stream in one of the three parallel configured heat exchange units HE3 to form a vaporized or partially vaporized, higher pressure, basic rich solution stream and a cooled first condensing working fluid substream, b) heat from the second condensing working fluid substream to a higher pressure, basic lean solution stream in a second of the three parallel configured heat exchange units HE4 to form a partially vaporized, higher pressure basic lean solution stream and a cooled second condensing working fluid substream, and c) heat from the third condensing working fluid substream to a first higher pressure, first separator lean substream in a third of the three parallel configured heat exchange units HE7 to form the first higher pressure, heated first separator lean substream and a cooled third condensing working fluid substream, combining the cooled first condensing working fluid substream, the cooled second condensing working fluid substream and the cooled third condensing working fluid substream to form a combined working fluid stream, separating the combined working fluid stream in the first separator SP1 to form a vapor first separator rich stream and a liquid first separator lean stream, dividing the liquid first separator lean stream into the first liquid first separator lean substream, a second liquid first separator lean substream and a third liquid first separator lean substream, pressurizing the first liquid first separator lean substream in the fifth pump P5 to form the higher pressure, first liquid first separator lean substream, combining the third liquid first separator lean substream with the vapor first separator rich stream to form a basic rich solution stream, transferring heat form the basic rich solution stream to a higher pressure, fully condensed basic rich solution stream in the single heat exchange unit HE2 to form the preheated, higher pressure, basic rich solution stream and a cooled basic rich solution stream, and pressurizing the second liquid first separator lean substream in the second pump P2 to form a higher pressure, second liquid first separator lean substream, and the condensing step comprises:

condensing the cooled basic rich solution stream in the final condenser HE1*b* with a coolant stream to form a fully condensed, basic rich solution stream and a spent coolant stream, and pressurizing the fully condensed, basic rich solution stream in a first pump P1 to form the higher pressure, fully condensed, basic rich solution stream.

11. The process of claim 10, further comprising:

feeding a fuel stream and a mixed air flue gas stream into a combustor to form a hot flue gas stream, combining the hot flue gas stream with a first higher pressure, cooled flue gas substream to form a reduced temperature flue gas steam, transferring heat from the reduced temperature flue gas steam to the spent heat source stream from the HRVG to produce the initial heat source stream and a cooled flue gas stream, dividing the cooled flue gas stream into a first cooled flue gas substream and a second cooled flue gas substream, pressurizing the second cooled flue gas substream in a fan to produce a higher pressure, cooled flue gas stream, dividing higher pressure, cooled flue gas stream into a first higher pressure, cooled flue gas substream and a second higher pressure, cooled flue gas sub stream, and combining the second higher pressure, cooled flue gas sub stream with an air stream to from the mixed air flue gas stream.

12. The process of claim 1, wherein:

the HCSS further includes two parallel configured heat exchange units HE5 and HE6, a second pump P2, and a fifth pump P5, the CSS further includes a third separator SP3, a first pump P1, and a third pump P3, the vaporizing and superheating step comprises:

dividing the spent working solution stream into a first spent working solution substream and a spent working solution substream, simultaneously transferring: a) heat from the first spent working solution substream to a heated preheated, higher pressure, basic rich solution stream in one of the two parallel configured heat exchange units HE5 to form a vaporized or superheated, higher pressure, basic rich solution stream and a cooled first spent working solution substream, and b) heat from the second spent working solution substream to a heated, higher pressure, basic lean solution stream in the second of the two parallel configured heat exchange units HE6 to form a partially vaporized, higher pressure, basic lean solution stream and a cooled second spent working solution substream, combining the cooled first spent working solution substream with a cooled second spent working solution substream to form a cooled spent working solution stream, combining the cooled spent working solution stream with a first higher pressure, heated first separator lean substream to form a condensing working fluid stream, simultaneously transferring: a) heat from the first condensing working fluid substream to a preheated, higher pressure, basic rich solution stream in one of the three parallel configured heat exchange units HE3 to form a vaporized or partially vaporized, higher pressure, basic rich solution stream and a cooled first condensing working fluid substream, b) heat from the second condensing working fluid substream to a higher pressure, basic lean solution stream in the second of the three parallel configured heat exchange units HE4 to form a partially vaporized, higher pressure basic lean solution stream and a cooled second condensing working fluid substream, and c) heat from the third condensing working fluid substream to a first higher pressure, first separator lean substream in the third of the three parallel configured heat exchange units HE7 to form the first higher pressure, heated first separator lean substream and a cooled third condensing working fluid substream, combining the cooled first condensing working fluid substream, the cooled second condensing working fluid substream and the cooled third condensing working fluid substream to form a combined working fluid stream, separating the combined working fluid stream in the first separator SP1 to form a vapor first separator rich stream and a liquid first separator lean stream, dividing the liquid first separator lean stream into the first liquid first separator lean substream, a second liquid first separator lean substream and a third liquid first separator lean substream, pressurizing the first liquid first separator lean substream in the fifth pump P5 to form the higher pressure, first liquid first separator lean substream, combining the third liquid first separator lean substream with the vapor first separator rich stream to form a basic rich solution stream, transferring heat form the vapor first separator rich stream to a higher pressure, fully condensed basic rich solution stream in the single heat exchange unit HE2 to form the preheated, higher pressure, basic rich solution stream and a mixed first separator rich stream, and pressurizing the second liquid first separator lean substream in a second pump P2 to form a higher pressure, second liquid first separator lean substream, and the condensing step comprises:

separating the mixed first separator rich stream in a third separator SP3 to form a vapor third separator rich stream and a liquid third separator lean stream, dividing the liquid third separator lean stream into a first liquid third separator lean substream and a second liquid third separator lean substream, pressurizing the second liquid third separator lean substream in a third pump P3 to form the second higher pressure, liquid third separator lean substream, combining the vapor third separator rich stream with the first liquid third separator lean substream to form a basic rich solution stream, condensing the basic rich solution stream in a final condenser HE1*b* with a coolant stream to form a fully condensed, basic rich solution stream and the cooled coolant stream, and pressurizing the fully condensed, basic rich solution stream in a first pump P1 to form the higher pressure, fully condensed, basic rich solution stream.

13. The process of claim 12, further comprising:

feeding a fuel stream and a mixed air flue gas stream into a combustor to form a hot flue gas stream, combining the hot flue gas stream with a first higher pressure, cooled flue gas substream to form a reduced temperature flue gas steam, transferring heat from the reduced temperature flue gas steam to the spent heat source stream from the HRVG to produce the initial heat source stream and a cooled flue gas stream, dividing the cooled flue gas stream into a first cooled flue gas substream and a second cooled flue gas substream, pressurizing the second cooled flue gas substream in a fan to produce a higher pressure, cooled flue gas stream, dividing higher pressure, cooled flue gas stream into a first higher pressure, cooled flue gas substream and a second higher pressure, cooled flue gas sub stream, and combining the second higher pressure, cooled flue gas sub stream with an air stream to from the mixed air flue gas stream.

14. The process of claim 1, wherein:

the HCSS further includes two parallel configured heat exchange units HE5 and HE6, a second pump P2, and a fifth pump P5, the CSS further includes a precondenser HE1*a*, a first pump P1, and a third separator SP3, the vaporizing and superheating step comprises:

dividing the spent working solution stream into a first spent working solution substream and a spent working solution substream, simultaneously transferring: a) heat from the first spent working solution substream to a heated preheated, higher pressure, basic rich solution stream in one of the two parallel configured heat exchange units HE5 to form a vaporized or superheated, higher pressure, basic rich solution stream and a cooled first spent working solution substream, and b) heat from the second spent working solution substream to a heated, higher pressure, basic lean solution stream in a second of the two parallel configured heat exchange units HE6 to form a partially vaporized, higher pressure, basic lean solution stream and a cooled second spent working solution substream, combining the cooled first spent working solution substream with a cooled second spent working solution substream to form a cooled spent working solution stream, combining the cooled spent working solution stream with a first higher pressure, heated first separator lean substream to form a condensing working fluid stream, simultaneously transferring: a) heat from the first condensing working fluid substream to a preheated, higher pressure, basic rich solution stream in one of the three parallel configured heat exchange units HE3 to form a vaporized or partially vaporized, higher pressure, basic rich solution stream and a cooled first condensing working fluid substream, b) heat from the second condensing working fluid substream to a higher pressure, basic lean solution stream in a second of the three parallel configured heat exchange units HE4 to form a partially vaporized, higher pressure basic lean solution stream and a cooled second condensing working fluid substream, and c) heat from the third condensing working fluid substream to a first higher pressure, first separator lean substream in a third of the three parallel configured heat exchange units HE7 to form the first higher pressure, heated first separator lean substream and a cooled third condensing working fluid substream, combining the cooled first condensing working fluid substream, the cooled second condensing working fluid substream and the cooled third condensing working fluid substream to form a combined working fluid stream, separating the combined working fluid stream in the first separator SP1 to form a vapor first separator rich stream and a liquid first separator lean stream, dividing the liquid first separator lean stream into the first liquid first separator lean substream and a second liquid first separator lean substream, pressurizing the first liquid first separator lean substream in the fifth pump P5 to form the higher pressure, first liquid first separator lean substream, transferring heat form the vapor first separator rich stream to a higher pressure, fully condensed basic rich solution stream in the single heat exchange unit HE2 to form the preheated, higher pressure, basic rich solution stream and a cooled first separator rich stream, and pressurizing the second liquid first separator lean substream in a second pump P2 to form a higher pressure, second liquid first separator lean substream, and the condensing step comprises:

partially condensing the cooled first separator rich stream with a cooled external coolant stream in the precondenser HE1*a* to from a spent external coolant stream and a partially condensed first separator rich stream, separating the partially condensed first separator rich stream in a third separator SP3 to form a vapor third separator rich stream and a liquid third separator lean stream, dividing the liquid third separator lean stream into a first liquid third separator lean substream and a second liquid third separator lean substream, pressurizing the second liquid third separator lean substream in the third pump P3 to form the second higher pressure, liquid third separator lean substream, combining the vapor third separator rich stream with the first liquid third separator lean substream to form a basic rich solution stream, condensing the basic rich solution stream in the final condenser HE1*b* with a coolant stream to form a fully condensed, basic rich solution stream and the cooled coolant stream, and pressurizing the fully condensed, basic rich solution stream in the first pump P1 to form the higher pressure, fully condensed, basic rich solution stream.

15. The process of claim 14, further comprising:

feeding a fuel stream and a mixed air flue gas stream into a combustor to form a hot flue gas stream, combining the hot flue gas stream with a first higher pressure, cooled flue gas substream to form a reduced temperature flue gas steam, transferring heat from the reduced temperature flue gas steam to the spent heat source stream from the HRVG to produce the initial heat source stream and a cooled flue gas stream, dividing the cooled flue gas stream into a first cooled flue gas substream and a second cooled flue gas substream, pressurizing the second cooled flue gas substream in a fan to produce a higher pressure, cooled flue gas stream, dividing higher pressure, cooled flue gas stream into a first higher pressure, cooled flue gas substream and a second higher pressure, cooled flue gas sub stream, and combining the second higher pressure, cooled flue gas sub stream with an air stream to from the mixed air flue gas stream.

16. A process for generating power from a heat source stream comprising:

providing a power system (PS) comprising:

a power generation subsystem (PGSS) including:

a vaporization and power generation subsystem (VPSS) comprising:

a turbine T1, a heat recovery vapor generator HRVG, a throttle control valve TV1, a second separator SP2, a cyclone separator C, and a fan F4, a heating and cooling subsystem (HCSS) comprising:

two parallel configured heat exchange units HE5 and HE6, three parallel configured heat exchange units HE3, HE4, and HE7, a single heat exchange unit HE2, a first separator SP1, a second pump P2 and, a fifth pump P5, a condensing subsystem (CSS) comprising:

a precondenser HE1*a*, a final condenser HE1*b*, a third separator SP3, a first pump P1, and a third pump P3, and a heat source subsystem (HSSS) including:

a first RCSS heat exchange unit RCSSHE1, a fan F, a combustor or combustion chamber CC, an air source AS, a fuel source FS, feeding a fuel stream and a mixed air flue gas stream into a combustor to form a hot flue gas stream, combining the hot flue gas stream with a first higher pressure, cooled flue gas substream to form a reduced temperature flue gas steam, transferring heat from the reduced temperature flue gas steam to the spent heat source stream from the HRVG in the first RCSS heat exchange unit RCSSHE1 to produce the initial heat source stream and a cooled flue gas stream, dividing the cooled flue gas stream into a first cooled flue gas substream and a second cooled flue gas substream, pressurizing the second cooled flue gas substream in a fan to produce a higher pressure, cooled flue gas stream, dividing higher pressure, cooled flue gas stream into a first higher pressure, cooled flue gas substream and a second higher pressure, cooled flue gas sub stream, combining the second higher pressure, cooled flue gas sub stream with an air stream from the air source AS to from the mixed air flue gas stream, separating the working solution stream in the a second separator SP2 into a rich vapor stream and a lean liquid stream, vaporizing and superheating the rich vapor stream in the HRVG to form a vaporized and superheated rich stream, vaporizing and superheating the lean liquid stream in the HRVG to form a vaporized and superheated lean stream, combining the vaporized and superheated rich stream and the vaporized and superheated lean stream to the vaporized and superheated working solution stream, and converting a portion of heat in the pressure adjusted, vaporized and superheated working solution stream in the turbine T1 to form the spent working fluid stream, pressure adjusting the vaporized and superheated working solution stream in in the throttle control valve TV1 to form a pressure adjusted, vaporized and superheated working solution stream and converting a portion of heat in the pressure adjusted, vaporized and superheated working solution stream in the turbine T1 to form the spent working fluid stream, combining the initial heat source stream with a higher pressure, cooled heat source substream to form a mixed heat source stream, dividing the cooled heat source stream into a first cooled heat source substream and a second cooled heat source substream, pressurizing the second cooled heat source substream in a fan F4 to from the higher pressure, cooled heat source substream, sending the mixed heat source stream into a cyclone separator C to remove any particulate material in the mixed heat source stream to form a substantially particulate free or particulate free heat source stream, using the substantially particulate free or particulate free heat source stream as the heat source stream for the heat recovery vapor generator HRVG, combining the spent working solution stream with a first higher pressure, heated first separator lean substream to form a condensing working fluid stream, dividing the condensing working fluid stream into a first condensing working fluid substream, a second condensing working fluid substream, and a third condensing working fluid substream, simultaneously transferring: a) heat from the first condensing working fluid substream to a preheated, higher pressure, basic rich solution stream in one of the three parallel configured heat exchange units HE3 to form a vaporized or partially vaporized, higher pressure, basic rich solution stream and a cooled first condensing working fluid substream, b) heat from the second condensing working fluid substream to a higher pressure, basic lean solution stream in a second of the three parallel configured heat exchange units HE4 to form a partially vaporized, higher pressure basic lean solution stream and a cooled second condensing working fluid substream, and c) heat from the third condensing working fluid substream to a first higher pressure, first separator lean substream in a third of the three parallel configured heat exchange units HE7 to form the first higher pressure, heated first separator lean substream and a cooled third condensing working fluid substream, combining the cooled first condensing working fluid substream, the cooled second condensing working fluid substream and the cooled third condensing working fluid substream to form a combined working fluid stream, separating the combined working fluid stream in the first separator SP1 to form a vapor first separator rich stream and a liquid first separator lean stream, dividing the liquid first separator lean stream into the first liquid first separator lean substream and a second liquid first separator lean substream, pressurizing the first liquid first separator lean substream in the fifth pump P5 to form the higher pressure, first liquid first separator lean substream, transferring heat form the vapor first separator rich stream to a higher pressure, basic rich solution stream in the single heat exchange unit HE2 to form the preheated, higher pressure, basic rich solution stream and a cooled first separator rich stream, pressurizing the second liquid first separator lean substream in the second pump P2 to form a higher pressure, second liquid first separator lean substream, combining the higher pressure, second liquid first separator lean substream with a second higher pressure, liquid third separator lean stream to form the higher pressure, basic lean solution stream, and combining the vaporized, higher pressure, basic rich solution stream and the partially vaporized, higher pressure, basic lean solution stream to form the working solution stream;

partially condensing the cooled first separator rich stream with a cooled external coolant stream in the precondenser HE1*a* to from a spent external coolant stream and a partially condensed first separator rich stream, separating the partially condensed first separator rich stream in a third separator SP3 to form a vapor third separator rich stream and a liquid third separator lean stream, dividing the liquid third separator lean stream into a first liquid third separator lean substream and a second liquid third separator lean substream, pressurizing the second liquid third separator lean substream in the third pump P3 to form the second higher pressure, liquid third separator lean substream, combining the vapor third separator rich stream with the first liquid third separator lean substream to form a basic rich solution stream, condensing the basic rich solution stream in the final condenser HE1*b* with a coolant stream to form a fully condensed, basic rich solution stream and the cooled coolant stream, and pressurizing the fully condensed, basic rich solution stream in the first pump P1 to form the higher pressure, fully condensed, basic rich solution stream.

17. A process for generating power from a heat source stream comprising:

providing a power system (PS) comprising:

a power generation subsystem (PGSS) including:

a vaporization and power generation subsystem (VPSS) comprising:

a turbine Ti, a heat recovery vapor generator HRVG, a throttle control valve TV1, a second separator SP2, a cyclone separator C, and a fan F4, a heating and cooling subsystem (HCSS) comprising:

two parallel configured heat exchange units HE5 and HE6, three parallel configured heat exchange units HE3, HE4, and HE7, a single heat exchange unit HE2, a first separator SP1, a second pump P2 and, a fifth pump P5, a condensing subsystem (CSS) comprising:

a final condenser HE1*b*, a third separator SP3, a first pump P1, and a third pump P3, and a heat source subsystem (HSSS) including:

a first RCSS heat exchange unit RCSSHE1, a fan F, a combustor or combustion chamber CC, an air source AS, a fuel source FS, feeding a fuel stream and a mixed air flue gas stream into a combustor to form a hot flue gas stream, combining the hot flue gas stream with a first higher pressure, cooled flue gas substream to form a reduced temperature flue gas steam, transferring heat from the reduced temperature flue gas steam to the spent heat source stream from the HRVG in the first RCSS heat exchange unit RCSSHE1 to produce the initial heat source stream and a cooled flue gas stream, dividing the cooled flue gas stream into a first cooled flue gas substream and a second cooled flue gas substream, pressurizing the second cooled flue gas substream in a fan to produce a higher pressure, cooled flue gas stream, dividing higher pressure, cooled flue gas stream into a first higher pressure, cooled flue gas substream and a second higher pressure, cooled flue gas sub stream, combining the second higher pressure, cooled flue gas sub stream with an air stream from the air source AS to from the mixed air flue gas stream, separating the working solution stream in the a second separator SP2 into a rich vapor stream and a lean liquid stream, vaporizing and superheating the rich vapor stream in the HRVG to form a vaporized and superheated rich stream, vaporizing and superheating the lean liquid stream in the HRVG to form a vaporized and superheated lean stream, combining the vaporized and superheated rich stream and the vaporized and superheated lean stream to the vaporized and superheated working solution stream, and converting a portion of heat in the pressure adjusted, vaporized and superheated working solution stream in the turbine T1 to form the spent working fluid stream, pressure adjusting the vaporized and superheated working solution stream in in the throttle control valve TV1 to form a pressure adjusted, vaporized and superheated working solution stream and converting a portion of heat in the pressure adjusted, vaporized and superheated working solution stream in the turbine T1 to form the spent working fluid stream, combining the initial heat source stream with a higher pressure, cooled heat source substream to form a mixed heat source stream, dividing the cooled heat source stream into a first cooled heat source substream and a second cooled heat source substream, pressurizing the second cooled heat source substream in a fan F4 to from the higher pressure, cooled heat source substream, sending the mixed heat source stream into a cyclone separator C to remove any particulate material in the mixed heat source stream to form a substantially particulate free or particulate free heat source stream, using the substantially particulate free or particulate free heat source stream as the heat source stream for the heat recovery vapor generator HRVG, dividing the spent working solution stream into a first spent working solution substream and a spent working solution substream, simultaneously transferring: a) heat from the first spent working solution substream to a heated preheated, higher pressure, basic rich solution stream in one of the two parallel configured heat exchange units HE5 to form a vaporized or superheated, higher pressure, basic rich solution stream and a cooled first spent working solution substream, and b) heat from the second spent working solution substream to a heated, higher pressure, basic lean solution stream in a second of the two parallel configured heat exchange units HE6 to form a partially vaporized, higher pressure, basic lean solution stream and a cooled second spent working solution substream, combining the cooled first spent working solution substream with a cooled second spent working solution substream to form a cooled spent working solution stream, combining the cooled spent working solution stream with a first higher pressure, heated first separator lean substream to form a condensing working fluid stream, simultaneously transferring: a) heat from the first condensing working fluid substream to a preheated, higher pressure, basic rich solution stream in one of the three parallel configured heat exchange units HE3 to form a vaporized or partially vaporized, higher pressure, basic rich solution stream and a cooled first condensing working fluid substream, b) heat from the second condensing working fluid substream to a higher pressure, basic lean solution stream in a second of the three parallel configured heat exchange units HE4 to form a partially vaporized, higher pressure basic lean solution stream and a cooled second condensing working fluid substream, and c) heat from the third condensing working fluid substream to a first higher pressure, first separator lean substream in a third of the three parallel configured heat exchange units HE7 to form the first higher pressure, heated first separator lean substream and a cooled third condensing working fluid substream, combining the cooled first condensing working fluid substream, the cooled second condensing working fluid substream and the cooled third condensing working fluid substream to form a combined working fluid stream, separating the combined working fluid stream in the first separator SP1 to form a vapor first separator rich stream and a liquid first separator lean stream, dividing the liquid first separator lean stream into the first liquid first separator lean substream, a second liquid first separator lean substream and a third liquid first separator lean substream, pressurizing the first liquid first separator lean substream in the fifth pump P5 to form the higher pressure, first liquid first separator lean substream, combining the third liquid first separator lean substream with the vapor first separator rich stream to form a basic rich solution stream, transferring heat form the basic rich solution stream to a higher pressure, fully condensed basic rich solution stream in the single heat exchange unit HE2 to form the preheated, higher pressure, basic rich solution stream and a cooled basic rich solution stream, and pressurizing the second liquid first separator lean substream in the second pump P2 to form a higher pressure, second liquid first separator lean substream, condensing the cooled basic rich solution stream in the final condenser HE1*b* with a coolant stream to form a fully condensed, basic rich solution stream and a spent coolant stream, and pressurizing the fully condensed, basic rich solution stream in a first pump P1 to form the higher pressure, fully condensed, basic rich solution stream.

18. A process for generating power from a heat source stream comprising:

providing a power system (PS) comprising:

a power generation subsystem (PGSS) including:

a vaporization and power generation subsystem (VPSS) comprising:

a turbine T1, a heat recovery vapor generator HRVG, a throttle control valve TV1, a second separator SP2, a cyclone separator C, and a fan F4, a heating and cooling subsystem (HCSS) comprising:

two parallel configured heat exchange units HE5 and HE6, three parallel configured heat exchange units HE3, HE4, and HE7, a single heat exchange unit HE2, a first separator SP1, a second pump P2 and, a fifth pump P5, a condensing subsystem (CSS) comprising:

a final condenser HE1*b*, and a first pump P1, and a heat source subsystem (HSSS) including:

a first RCSS heat exchange unit RCSSHE1, a fan F, a combustor or combustion chamber CC, an air source AS, a fuel source FS, feeding a fuel stream and a mixed air flue gas stream into a combustor to form a hot flue gas stream, combining the hot flue gas stream with a first higher pressure, cooled flue gas substream to form a reduced temperature flue gas steam, transferring heat from the reduced temperature flue gas steam to the spent heat source stream from the HRVG in the first RCSS heat exchange unit RCSSHE1 to produce the initial heat source stream and a cooled flue gas stream, dividing the cooled flue gas stream into a first cooled flue gas substream and a second cooled flue gas substream, pressurizing the second cooled flue gas substream in a fan to produce a higher pressure, cooled flue gas stream, dividing higher pressure, cooled flue gas stream into a first higher pressure, cooled flue gas substream and a second higher pressure, cooled flue gas sub stream, combining the second higher pressure, cooled flue gas sub stream with an air stream from the air source AS to from the mixed air flue gas stream, separating the working solution stream in the a second separator SP2 into a rich vapor stream and a lean liquid stream, vaporizing and superheating the rich vapor stream in the HRVG to form a vaporized and superheated rich stream, vaporizing and superheating the lean liquid stream in the HRVG to form a vaporized and superheated lean stream, combining the vaporized and superheated rich stream and the vaporized and superheated lean stream to the vaporized and superheated working solution stream, and converting a portion of heat in the pressure adjusted, vaporized and superheated working solution stream in the turbine T1 to form the spent working fluid stream, pressure adjusting the vaporized and superheated working solution stream in in the throttle control valve TV1 to form a pressure adjusted, vaporized and superheated working solution stream and converting a portion of heat in the pressure adjusted, vaporized and superheated working solution stream in the turbine T1 to form the spent working fluid stream, combining the initial heat source stream with a higher pressure, cooled heat source substream to form a mixed heat source stream, dividing the cooled heat source stream into a first cooled heat source substream and a second cooled heat source substream, pressurizing the second cooled heat source substream in a fan F4 to from the higher pressure, cooled heat source substream, sending the mixed heat source stream into a cyclone separator C to remove any particulate material in the mixed heat source stream to form a substantially particulate free or particulate free heat source stream, using the substantially particulate free or particulate free heat source stream as the heat source stream for the heat recovery vapor generator HRVG, dividing the spent working solution stream into a first spent working solution substream and a spent working solution substream, simultaneously transferring: a) heat from the first spent working solution substream to a heated preheated, higher pressure, basic rich solution stream in one of the two parallel configured heat exchange units HE5 to form a vaporized or superheated, higher pressure, basic rich solution stream and a cooled first spent working solution substream, and b) heat from the second spent working solution substream to a heated, higher pressure, basic lean solution stream in the second of the two parallel configured heat exchange units HE6 to form a partially vaporized, higher pressure, basic lean solution stream and a cooled second spent working solution substream, combining the cooled first spent working solution substream with a cooled second spent working solution substream to form a cooled spent working solution stream, combining the cooled spent working solution stream with a first higher pressure, heated first separator lean substream to form a condensing working fluid stream, simultaneously transferring: a) heat from the first condensing working fluid substream to a preheated, higher pressure, basic rich solution stream in one of the three parallel configured heat exchange units HE3 to form a vaporized or partially vaporized, higher pressure, basic rich solution stream and a cooled first condensing working fluid substream, b) heat from the second condensing working fluid substream to a higher pressure, basic lean solution stream in the second of the three parallel configured heat exchange units HE4 to form a partially vaporized, higher pressure basic lean solution stream and a cooled second condensing working fluid substream, and c) heat from the third condensing working fluid substream to a first higher pressure, first separator lean substream in the third of the three parallel configured heat exchange units HE7 to form the first higher pressure, heated first separator lean substream and a cooled third condensing working fluid substream, combining the cooled first condensing working fluid substream, the cooled second condensing working fluid substream and the cooled third condensing working fluid substream to form a combined working fluid stream, separating the combined working fluid stream in the first separator SP1 to form a vapor first separator rich stream and a liquid first separator lean stream, dividing the liquid first separator lean stream into the first liquid first separator lean substream, a second liquid first separator lean substream and a third liquid first separator lean substream, pressurizing the first liquid first separator lean substream in the fifth pump P5 to form the higher pressure, first liquid first separator lean substream, combining the third liquid first separator lean substream with the vapor first separator rich stream to form a basic rich solution stream, transferring heat form the vapor first separator rich stream to a higher pressure, fully condensed basic rich solution stream in the single heat exchange unit HE2 to form the preheated, higher pressure, basic rich solution stream and a mixed first separator rich stream, and pressurizing the second liquid first separator lean substream in a second pump P2 to form a higher pressure, second liquid first separator lean substream, separating the mixed first separator rich stream in a third separator SP3 to form a vapor third separator rich stream and a liquid third separator lean stream, dividing the liquid third separator lean stream into a first liquid third separator lean substream and a second liquid third separator lean substream, pressurizing the second liquid third separator lean substream in a third pump P3 to form the second higher pressure, liquid third separator lean substream, combining the vapor third separator rich stream with the first liquid third separator lean substream to form a basic rich solution stream, condensing the basic rich solution stream in a final condenser HE1*b* with a coolant stream to form a fully condensed, basic rich solution stream and the cooled coolant stream, and pressurizing the fully condensed, basic rich solution stream in a first pump P1 to form the higher pressure, fully condensed, basic rich solution stream.

19. A process for generating power from a heat source stream comprising:

providing a power system (PS) comprising:

a power generation subsystem (PGSS) including:

a vaporization and power generation subsystem (VPSS) comprising:

a turbine T1, a heat recovery vapor generator HRVG, a throttle control valve TV1, a second separator SP2,
a cyclone separator C, and
a fan F4,
a heating and cooling subsystem (HCSS) comprising:
two parallel configured heat exchange units HE5 and HE6,
three parallel configured heat exchange units HE3, HE4, and HE7,
a single heat exchange unit HE2,
a first separator SP1,
a second pump P2 and,
a fifth pump P5,
a condensing subsystem (CSS) comprising:
a precondenser HE1*a*,
a final condenser HE1*b*,
a third separator SP3,
a first pump P1, and
a third pump P3, and
a heat source subsystem (HSSS) including:
a first RCSS heat exchange unit RCSSHE1,
a fan F,
a combustor or combustion chamber CC,
an air source AS,
a fuel source FS, feeding a fuel stream and a mixed air flue gas stream into a combustor to form a hot flue gas stream, combining the hot flue gas stream with a first higher pressure, cooled flue gas substream to form a reduced temperature flue gas steam, transferring heat from the reduced temperature flue gas steam to the spent heat source stream from the HRVG in the first RCSS heat exchange unit RCSSHE1 to produce the initial heat source stream and a cooled flue gas stream, dividing the cooled flue gas stream into a first cooled flue gas substream and a second cooled flue gas substream, pressurizing the second cooled flue gas substream in a fan to produce a higher pressure, cooled flue gas stream, dividing higher pressure, cooled flue gas stream into a first higher pressure, cooled flue gas substream and a second higher pressure, cooled flue gas sub stream, combining the second higher pressure, cooled flue gas sub stream with an air stream from the air source AS to from the mixed air flue gas stream, separating the working solution stream in the a second separator SP2 into a rich vapor stream and a lean liquid stream, vaporizing and superheating the rich vapor stream in the HRVG to form a vaporized and superheated rich stream, vaporizing and superheating the lean liquid stream in the HRVG to form a vaporized and superheated lean stream, combining the vaporized and superheated rich stream and the vaporized and superheated lean stream to the vaporized and superheated working solution stream, and converting a portion of heat in the pressure adjusted, vaporized and superheated working solution stream in the turbine T1 to form the spent working fluid stream, pressure adjusting the vaporized and superheated working solution stream in in the throttle control valve TV1 to form a pressure adjusted, vaporized and superheated working solution stream and converting a portion of heat in the pressure adjusted, vaporized and superheated working solution stream in the turbine T1 to form the spent working fluid stream, combining the initial heat source stream with a higher pressure, cooled heat source substream to form a mixed heat source stream, dividing the cooled heat source stream into a first cooled heat source substream and a second cooled heat source substream, pressurizing the second cooled heat source substream in a fan F4 to from the higher pressure, cooled heat source substream, sending the mixed heat source stream into a cyclone separator C to remove any particulate material in the mixed heat source stream to form a substantially particulate free or particulate free heat source stream, using the substantially particulate free or particulate free heat source stream as the heat source stream for the heat recovery vapor generator HRVG, dividing the spent working solution stream into a first spent working solution substream and a spent working solution substream, simultaneously transferring: a) heat from the first spent working solution substream to a heated preheated, higher pressure, basic rich solution stream in one of the two parallel configured heat exchange units HE5 to form a vaporized or superheated, higher pressure, basic rich solution stream and a cooled first spent working solution substream, and b) heat from the second spent working solution substream to a heated, higher pressure, basic lean solution stream in a second of the two parallel configured heat exchange units HE6 to form a partially vaporized, higher pressure, basic lean solution stream and a cooled second spent working solution substream, combining the cooled first spent working solution substream with a cooled second spent working solution substream to form a cooled spent working solution stream, combining the cooled spent working solution stream with a first higher pressure, heated first separator lean substream to form a condensing working fluid stream, simultaneously transferring: a) heat from the first condensing working fluid substream to a preheated, higher pressure, basic rich solution stream in one of the three parallel configured heat exchange units HE3 to form a vaporized or partially vaporized, higher pressure, basic rich solution stream and a cooled first condensing working fluid substream, b) heat from the second condensing working fluid substream to a higher pressure, basic lean solution stream in a second of the three parallel configured heat exchange units HE4 to form a partially vaporized, higher pressure basic lean solution stream and a cooled second condensing working fluid substream, and c) heat from the third condensing working fluid substream to a first higher pressure, first separator lean substream in a third of the three parallel configured heat exchange units HE7 to form the first higher pressure, heated first separator lean substream and a cooled third condensing working fluid substream, combining the cooled first condensing working fluid substream, the cooled second condensing working fluid substream and the cooled third condensing working fluid substream to form a combined working fluid stream, separating the combined working fluid stream in the first separator SP1 to form a vapor first separator rich stream and a liquid first separator lean stream, dividing the liquid first separator lean stream into the first liquid first separator lean substream and a second liquid first separator lean substream, pressurizing the first liquid first separator lean substream in the fifth pump P5 to form the higher pressure, first liquid first separator lean substream, transferring heat form the vapor first separator rich stream to a higher pressure, fully condensed basic rich solution stream in the single heat exchange unit HE2 to form the preheated, higher pressure, basic rich solution stream and a cooled first separator rich stream, and pressurizing the second liquid first separator lean substream in a second pump P2 to form a higher pressure, second liquid first separator lean substream, partially condensing the cooled first separator rich stream with a cooled external coolant stream in the precondenser HE1*a* to from a spent external coolant stream and a partially condensed first separator rich stream, separating the partially condensed first separator rich stream in a third separator SP3 to form a vapor third separator rich stream and a liquid third separator lean stream, dividing the liquid third separator lean stream into a first liquid third separator lean substream and a second liquid third separator lean substream, pressurizing the second liquid third separator lean substream in the third pump P3 to form the second higher pressure, liquid third separator lean substream, combining the vapor third separator rich stream with the first liquid third separator lean substream to form a basic rich solution stream, condensing the basic rich solution stream in the final condenser HE1*b* with a coolant stream to form a fully condensed, basic rich solution stream and the cooled coolant stream, and pressurizing the fully condensed, basic rich solution stream in the first pump P1 to form the higher pressure, fully condensed, basic rich solution stream.

* * * * *